US007789686B2

(12) United States Patent
Kim

(10) Patent No.: US 7,789,686 B2
(45) Date of Patent: Sep. 7, 2010

(54) RECEPTACLE WITH THREE CIRCUIT FORMING APERTURES

(76) Inventor: Kyung T Kim, 24971 Eaton La., Laguna Niguel, CA (US) 92677

( * ) Notice: Subject to any disclaimer, the term of this patent is extended or adjusted under 35 U.S.C. 154(b) by 206 days.

(21) Appl. No.: 12/279,162

(22) PCT Filed: Feb. 12, 2007

(86) PCT No.: PCT/US2007/003832

§ 371 (c)(1),
(2), (4) Date: Aug. 12, 2008

(87) PCT Pub. No.: WO2007/095249

PCT Pub. Date: Aug. 23, 2007

(65) Prior Publication Data

US 2009/0203242 A1 Aug. 13, 2009

Related U.S. Application Data

(60) Provisional application No. 60/773,082, filed on Feb. 13, 2006.

(51) Int. Cl.
*H01R 27/00* (2006.01)

(52) U.S. Cl. ..... 439/218

(58) Field of Classification Search ..... 439/218, 439/211, 214, 215, 217, 76.1, 652
See application file for complete search history.

(56) References Cited

U.S. PATENT DOCUMENTS 1,933,358 A 10/1933 Almcrantz
2,313,452 A 3/1943 O'Brien
2,899,668 A 8/1959 Gribben
3,081,442 A 3/1963 Platz
3,466,453 A 9/1969 Greenberg
3,503,032 A 3/1970 Routh et al.
3,529,274 A 9/1970 Routh (Continued)

FOREIGN PATENT DOCUMENTS

DE 10255315 6/2004

(Continued)

OTHER PUBLICATIONS

Domestic AC power plugs and sockets, Wikipedia encyclopedia, Oct. 2006.

(Continued)

*Primary Examiner*—Chandrika Prasad
(74) *Attorney, Agent, or Firm*—Knobbe Martens Olson & Bear LLP

(57) ABSTRACT

Disclosed are methods and devices for the use of electricity. The methods and devices generally relate to receptacles and plugs in which two electrical sockets share a circuit forming aperture 2030. This not only saves space, but, depending upon the configuration and wiring of the device, allows for new uses. Disclosed are methods and device for inserting oversized plugs into a socket without covering another socket. Disclosed are methods and devices for allowing access to two different circuits at a single receptacle. This can be achieved without having to exclusively dedicate each socket of a receptacle to only a single circuit. Disclosed are methods and devices for providing/obtaining two-phase power from a tri-aperture dual socket receptacle.

25 Claims, 29 Drawing Sheets

U.S. PATENT DOCUMENTS

| | | | | |
|---|---|---|---|---|
| 4,629,268 | A | | 12/1986 | Hiles |
| 4,717,348 | A | | 1/1988 | Mazzullo et al. |
| 4,718,863 | A | | 1/1988 | Sadigh-Behzadi |
| 4,740,167 | A | | 4/1988 | Millhimes et al. |
| 4,815,983 | A | | 3/1989 | Erickson et al. |
| 4,853,823 | A | | 8/1989 | Arechavaleta |
| 5,007,848 | A | | 4/1991 | Lee |
| 5,046,963 | A | * | 9/1991 | Kelly ..... 439/211 |
| 5,106,314 | A | | 4/1992 | Bael |
| 5,368,490 | A | | 11/1994 | McKissick |
| 5,520,555 | A | | 5/1996 | Taylor |
| 5,544,274 | A | | 8/1996 | Walker et al. |
| 5,582,520 | A | | 12/1996 | Doudon |
| 5,582,522 | A | * | 12/1996 | Johnson ..... 439/214 |
| 5,603,621 | A | | 2/1997 | Elmouchi |
| 6,086,391 | A | | 7/2000 | Chiu |
| 6,086,397 | A | | 7/2000 | Chapman et al. |
| 6,135,820 | A | | 10/2000 | Chiang |
| 6,217,353 | B1 | | 4/2001 | Yu-Tse |
| 6,220,880 | B1 | | 4/2001 | Lee et al. |
| 6,227,883 | B1 | | 5/2001 | Lee et al. |
| 6,315,617 | B1 | | 11/2001 | Al-Sabah |
| 6,328,584 | B1 | | 12/2001 | Follett |
| 6,422,880 | B1 | | 7/2002 | Chiu |
| 6,641,419 | B1 | | 11/2003 | Richardson |
| D505,856 | S | | 6/2005 | Kim et al. |
| 7,052,299 | B2 | | 5/2006 | Kim et al. |
| 7,071,414 | B2 | | 7/2006 | Kim |
| D532,375 | S | | 11/2006 | Kim et al. |
| 7,198,499 | B2 | | 4/2007 | Kim |
| 7,214,079 | B2 | | 5/2007 | Kim |
| 7,547,221 | B2 | | 6/2009 | Kim et al. |
| 2005/0202689 | A1 | | 9/2005 | Kim et al. |
| 2007/0184703 | A1 | | 8/2007 | Kim et al. |

FOREIGN PATENT DOCUMENTS

| | | | |
|---|---|---|---|
| EP | 1089398 | | 4/2001 |
| GB | 2220803 | | 1/1990 |
| GB | 2344001 | | 5/2000 |
| JP | 2000-91046 | | 3/2000 |
| WO | WO 99/27618 | | 6/1999 |
| WO | WO 03/084819 | A2 | 10/2003 |
| WO | WO 2007/095249 | | 8/2007 |
| WO | WO 2009/149286 | | 12/2009 |

OTHER PUBLICATIONS

File Wrapper of U.S. Appl. No. 11/050,081, filed Feb. 2, 2005 entitled Low Voltage Electricity Distribution Circuit.

File Wrapper of U.S. Appl. No. 11/399,068, filed Apr. 5, 2006 entitled a Low Voltage Electricity Distribution Unit.

File Wrapper of U.S. Appl. No. 10/509,563, filed Sep. 28, 2004 entitled Low Voltage Electricity Distribution Circuit.

File Wrapper of U.S. Appl. No. 11/733,661, filed Apr. 10, 2007 entitled Low Voltage Electricity Distribution Circuit.

File Wrapper of U.S. Appl. No. 60/541,356, filed Feb. 2, 2004 entitled Dual-Circuit Receptacle Using Common Hot Terminal.

File Wrapper of U.S. Appl. No. 60/541,647, filed Feb. 3, 2004 entitled Child Safety Plugs for Outlets With More Than 2 Non-Ground Receptacles.

International Preliminary Report on Patentability, received in International Application No. PCT/US2007/003832, mailing date Aug. 28, 2008.

International Search Report and Written Opinion, received in International Application No. PCT/IB03/01244, mailing date Oct. 3, 2003.

International Preliminary Examination Report, received in International Application No. PCT/IB03/01244, dated Jan. 30, 2004, 3 pages.

International Search Report and Written Opinion, received in International Application No. PCT/US2007/003832, mailing date Apr. 9, 2008.

International Search Report and Written Opinion, received in International Application No. PCT/US2009/046300, mailing date Jan. 18, 2010.

International Search Report PCT US2009 046300 dated Jun. 4, 2009.

Notice of Request for Submission of Argument dated Feb. 19, 2010, Korean Intellectual Property Office, received in Korean application No. 10-2004-7015719, English translation only, 4 pages.

* cited by examiner

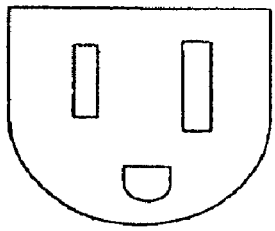
Fig. 1D
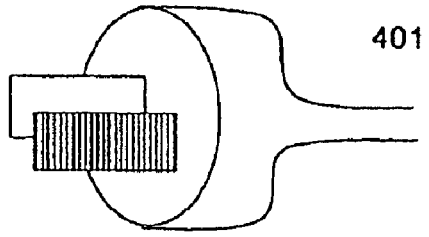
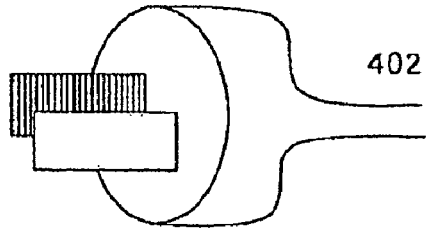
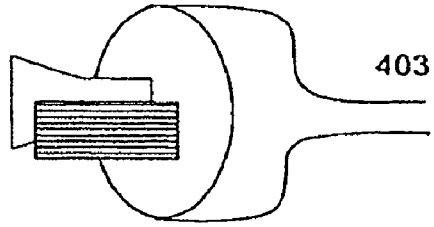
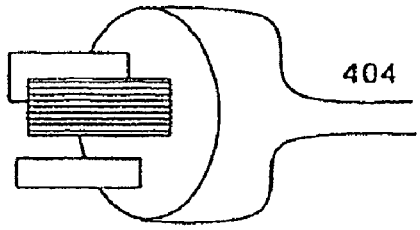
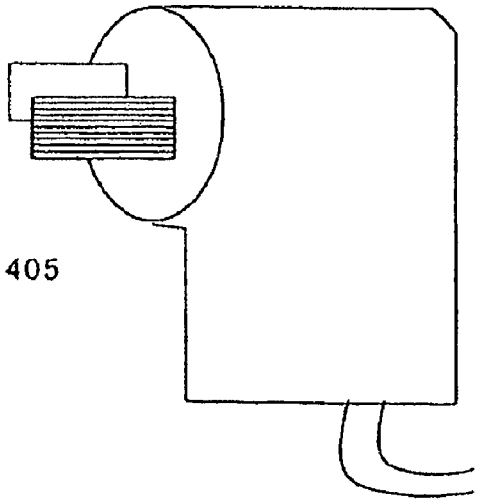

RECEPTACLE WITH THREE CIRCUIT FORMING APERTURES

RELATED APPLICATION

This application is the U.S. national phase entry under 35 U.S.C. §371 of PCT/US2007003832, filed Feb. 12, 2007, and claims priority to U.S. Provisional Patent Application No. 60/773,082, filed Feb. 13, 2006. Each of the priority applications is hereby incorporated by reference in its entirety.

FIELD OF THE INVENTION

The present invention relates generally to electricity distribution devices and methods. In particular, the invention relates to methods and devices involving multiple sockets and/or modified plugs.

BACKGROUND

In many places an electrical socket for a standard household electrical receptacle has traditionally had two circuit-forming apertures in each socket for supplying power to two circuit-forming prongs of a plug of an electrically driven device. Often, the socket will contain a third aperture, which serves to ground the electrical device. Commonly, there will be two such sockets in each receptacle. (See FIG. 1A) While some additional modifications and additions to this socket design have been made, such as arranging more than two sockets in a line, (e.g., a power strip), or the addition of a circuit breaker to the socket, little has been done to improve the overall usability of the electrical socket for today's electricity dependent environment.

One recent development, made by the current Inventor, is the rearrangement of the sockets and apertures on an electrical receptacle. This arrangement, depicted in FIG. 1B, results in two sockets being formed by three circuit-forming apertures. This arrangement has previously, and exclusively, used to allow for two different circuits (e.g., one switchable and the other unswitched) to be effectively hooked up to the receptacle. One could then choose which circuit one wished to use by rotating and moving the plug to the appropriate set of apertures. FIG. 1B which depicts two tri-aperture dual sockets ("TADS") 2001 and 2002.

SUMMARY OF THE INVENTION

In some aspects, the present disclosure discusses how the arrangement of apertures and sockets in FIG. 1 can be advantageously used and modified for particular applications.

In some aspects, an electrical receptacle is provided. The electrical receptacle comprises a first electrical conductor, a second electrical conductor, and an element having a first aperture, a second aperture, and a third aperture. The first aperture allows a first prong of an electrical plug to contact the first electrical conductor. The second aperture allows a second prong of the electrical plug to contact the second electrical conductor. The third aperture allows the first prong of the electrical plug to contact the first electrical conductor. The apertures are arranged and configured so that two circuit prongs of a standard-sized electrical plug can be inserted into either the first and second apertures or the second and third apertures. In some embodiments the first conductor is a single piece of metal. In some embodiments the first conductor comprises a first section aligned with the first aperture, a second section aligned with the third aperture, and a third section in electrical communication with the first and second sections.

In some embodiments, the element includes a fourth aperture, a fifth aperture, a third conductor and a fourth conductor. The fourth aperture is configured to receive a ground prong of a plug having circuit prongs inserted into the first and second apertures. The fifth aperture is configured to receive a ground prong of a plug having circuit prongs inserted into the second and third apertures. The receptacle can further comprise a third conductor, wherein insertion of a ground prong of a plug into the fourth aperture provides electrical communication between the ground prong and the third conductor, and wherein the fifth aperture exposes the fourth conductor. In some embodiments, the fourth and fifth conductors are a single conductor. In some embodiments, it further comprises a first plug inserted into the first and second apertures in a first orientation. In some embodiments, it further comprises a plug inserted into the second and third apertures in a second orientation.

In some embodiments, the electrical receptacle further comprises a fourth aperture, a fifth aperture, and a sixth aperture. The fourth aperture allows a first prong of an electrical plug to contact the first electrical conductor. The fifth aperture allows a second prong of the electrical plug to contact the second electrical conductor. The sixth aperture allows the first prong of the electrical plug to contact the first electrical conductor. The apertures are arranged and configured so that two circuit prongs of a standard-sized electrical plug can be inserted into either the fourth and fifth apertures or the fifth and sixth apertures. In some embodiments, the fourth aperture is positioned beneath the first aperture, the fifth aperture is positioned beneath the second aperture, and the sixth aperture is positioned beneath the third aperture.

In some aspects, a method of providing power to an oversized electrical plug is provided. The method comprises providing an electrical receptacle that comprises a first electrical conductor, a second electrical conductor, and a receptacle having a first aperture, a second aperture, and a third aperture. The first aperture allows a first prong of a type A electrical plug in a first orientation to contact the first electrical conductor. The second aperture allows a second prong of the electrical plug in the first orientation to contact the second electrical conductor. The third aperture allows the first prong of the electrical plug in a second orientation to contact the first electrical conductor when the second prong of the electrical plug in the second orientation is inserted into the second aperture. The method further comprises inserting the prongs of an oversized electrical plug into two apertures, wherein said two apertures form a first socket, and wherein said oversized plug is large enough to at least, in some orientation, partially cover the first socket it is inserted into while simultaneously at least partially covering another socket on the electrical receptacle that is not made up of the first, second, or third apertures. In some embodiments, the second aperture is configured to accept a polarized prong of the oversized electrical plug and the first and third apertures are positioned on either side of the second aperture. In some embodiments, a first and second prong of the oversized plug are inserted into the first and second apertures of the electrical receptacle respectively. In some embodiments, the method further comprises providing the electrical receptacle that further comprises a fourth aperture, a fifth aperture, and a sixth aperture, wherein the fourth aperture allows a first prong from a second plug to contact the first electrical conductor, wherein the fifth aperture allows a second prong from the second plug to contact the second electrical conductor, and wherein the sixth aperture allows the first prong from the second plug to contact the first conductor when said second prong from the second plug is inserted into the fifth aperture. In some embodiments, the method further comprises inserting a set of prongs of a second oversized electrical plug into the fifth and sixth apertures. In some embodiments, the first and second oversized plugs are rotated 180 degrees with respect to one another. In some embodiments, the second aperture is configured to receive a polarized prong of an electrical plug. In some embodiments, the electrical receptacle further comprises a first ground aperture, a second ground aperture, a third ground aperture, and a fourth ground aperture. The grounding prong of the first plug is inserted into the first ground aperture and a grounding prong of the second plug is inserted into a fourth ground aperture.

In some aspects, an electrical receptacle for allowing access to two voltage sources is provided. The electrical receptor comprises a first electrical conductor, a second electrical conductor, a third electrical conductor, and an element. The element has first and second sockets. The first socket comprises a first aperture and a second aperture. The second socket comprises the second aperture and a third aperture. The first aperture allows a first circuit prong of an electrical plug to contact the first electrical conductor. The second aperture allows a second circuit prong of the electrical plug to contact the second electrical conductor. The third aperture allows the first circuit prong of the electrical plug to contact the third electrical conductor when the second circuit prong of the plug is in the second aperture. The electrical receptacle further comprises a first hot line connected to the first conductor, a first neutral line connected to the second conductor, and a second hot line connected to the third conductor, wherein the first and second hot lines are each part of a different circuit. In some embodiments, the first hot line is within a circuit controlled by a first circuit breaker. In some embodiments, the second hot line is within a circuit controlled by a second circuit breaker. In some embodiments, the first and second hot lines and the first neutral lines are part of a 12/3 or 14/3 NM wire. In some embodiments, the first hot line is part of a first 20 amp circuit and wherein the second hot line is part of a second 20 amp circuit. In some embodiments, the first hot line comprises a first voltage at a first phase, and the second hot line comprises a second voltage at a second phase, and the first and second voltages are about 180 degrees out of phase. In some embodiments, the first and second hot lines are at least the size of a 14 gauge line. In some embodiments, the first and second hot lines have a size that are at least of the size selected from the group consisting of 12 and 10 gauge line. In some embodiments, the first and second hot lines are at least the size of an 8 gauge line.

In some aspects, a system of receptacles each providing electrical access to two different circuits is provided. The system comprises at least two receptacles. Each receptacle allows for insertion of at least two plugs into the receptacle. The receptacle is configured so that two plugs inserted into the receptacle can (i) in a first arrangement, both draw power from the first circuit, (ii) in a second arrangement, both draw power from the second circuit, or (iii) in a third arrangement, one plug can draw power from the first circuit and the other plug can draw power from the second circuit.

In some aspects, a method for delivering two independent circuits to a single electrical receptacle is provided. The method comprises providing an electrical receptacle comprising a first electrical conductor, a second electrical conductor, a third electrical conductor, and an element having first and second sockets each adapted to receive two circuit plugs of a standard-size electrical plug. The first socket comprises first and second apertures in the element. The second socket comprises the second aperture and a third aperture in the element. Insertion of a prong of an electrical plug into the first aperture provides electrical communication between the prong and the first electrical conductor. Insertion of a prong of an electrical plug into the second aperture provides electrical communication between the prong and the second electrical conductor. Insertion of a prong of an electrical plug into the third aperture provides electrical communication between the prong and the third electrical conductor when the second prong of the electrical plug is inserted into the second aperture. The first conductor is conductively connected to a first circuit. The third conductor is conductively associated with a second circuit so that inserting an electrical plug into the first socket allows one to use the first circuit and so that inserting the electrical plug into the second socket allows one to use the second circuit. In some embodiments, the method further comprises inserting a first electrical plug into the first or second sockets. In some embodiments, the first circuit includes a first hot wire and a first breaker, and the second circuit includes a second hot wire and a second breaker. In some embodiments, the element further includes third and fourth sockets each adapted to receive two circuit prongs of an electrical plug. The third socket comprises fourth and fifth apertures in the element. The fourth socket comprises the fifth aperture and a sixth aperture in the element. Insertion of a prong of an electrical plug into the fourth aperture provides electrical communication between the prong and the first electrical conductor. Insertion of a prong of an electrical plug into the fifth aperture provides electrical communication between the prong and the second electrical conductor. Insertion of a prong of an electrical plug into the sixth aperture provides electrical communication between the prong and the third electrical conductor. The method further comprises inserting a second plug into the third or fourth sockets so that the first and second plugs are not both in electrical communication with the first conductor or the third conductor at the same time. In some embodiments, a voltage in the first circuit and a voltage in the second circuit are 180 degrees out of phase. In some embodiments, when the plug is inserted into the first or third sockets, the plug is in a first orientation and when the plug is inserted into the second or fourth sockets the plug is in a second orientation. In some embodiments, the first and second orientations are 180 degrees different.

In some aspects, a method for delivering power from two separate circuits through one receptacle is provided. The method comprises providing a system of receptacles, each providing electrical access to two different circuits. The system comprises at least two receptacles. Each receptacle allows for insertion of at least two plugs into the receptacle. The receptacle is configured so that two plugs inserted into the receptacle can (i) in a first arrangement, both draw power from the first circuit, (ii) in a second arrangement, both draw power from the second circuit, or (iii) in a third arrangement, one plug can draw power from the first circuit and the other plug can draw power from the second circuit. The method further comprises inserting a first plug into a receptacle so that the first plug draws power from the first circuit. In some embodiments, the method further comprises the step of inserting a second plug into the receptacle so that the second plug draws power from the first circuit. In some embodiments, the method further comprises the step of inserting a third plug into a receptacle so that the third plug draws power from the second circuit. In some embodiments, the method further comprises the step of inserting a fourth plug into a receptacle so that the fourth plug draws power from the second circuit. In some embodiments, the method further comprises the step of inserting a second plug into the receptacle so that the second plug draws power from the second circuit. In some embodiments, the method further comprises the step of inserting a third plug into a receptacle so that the third plug draws power from the first circuit. In some embodiments, the method further comprises the step of inserting a fourth plug into a receptacle so that the fourth plug draws power from the first or second circuit. In some embodiments, the method further comprises the step of inserting a first plug into a receptacle so that the first plug draws power from the second circuit.

In some aspects, a method for delivering two separate voltage sources to a single electrical receptacle is provided. The method comprises providing a first socket comprising first and second apertures. The first aperture exposes a first conductor that is part of a first circuit and the second aperture exposes a second conductor. The method further comprises providing a second socket comprising the second aperture and a third aperture. The second aperture exposes the second conductor, and the third aperture exposes a third conductor that is part of a second circuit. The second aperture is configured to closely receive a polarized plug. In some embodiments, the method further comprises inserting a first standard-size electrical plug into the first socket. In some embodiments, the method further comprises inserting a second standard-size electrical plug into the second socket.

In some aspects an electrical plug comprising first, second, and third circuit prongs arranged substantially along a single line is provided. In some embodiments, the first and third prongs are about twice as far apart as a type A electrical plug; the second prong being about midway between the first and third prongs. In some embodiments, the plug further comprises a grounding prong located on an axis of symmetry between the first and second prongs. In some embodiments, the plug further comprises a first line connected to the first prong, a second line connected to the second prong and a third line connected to the third prong. In some embodiments, the first line is at least as heavy as a wire selected from the group consisting of 18, 16, 14, 12, 10, and 8 gauge. In some embodiments, the second line is at least as heavy as a wire selected from the group consisting of 18, 16, 14, 12, 10, and 8 gauge. In some embodiments, the third line is at least as heavy as a wire selected from the group consisting of 18, 16, 14, 12, 10, and 8 gauge. In some embodiments, the plug further comprises a fourth line connected to the ground prong, wherein the first, second, third, and fourth lines comprise the electrical cord of the plug. In some embodiments, the first and third lines are connected to a load that uses two-phase power. In some embodiments, the first and second or the second and third lines are connected to a load that uses single phase power. In some embodiments, the first and third lines are connected to a load that uses two-phase power.

In some aspects, an electrical plug is provided. The electrical plug comprises first and second circuit prongs located about twice as far apart from one another as two circuit prongs of a type A electrical plug. In some embodiments, the exposed part of the first and second prongs are generally shaped as a rectangular when viewed on end. In some embodiments, the plug further comprises a ground prong. In some embodiments, the ground prong is displaced from an axis of symmetry between the first and second prongs. In some embodiments, the ground prong is located substantially along a line that is perpendicular to a chord whose endpoints are on the prongs, the chord being perpendicular to the prongs, the line being distanced from one of the prongs by one-quarter of the length of the chord.

In some aspects, an electrical receptacle configured for delivering two-phase power is provided. The electrical receptacle comprises a first electrical conductor, a second electrical conductor, a third electrical conductor, and an element having first and second sockets each adapted to receive two circuit prongs of a standard-size electrical plug. The first socket comprises first and second apertures in the element. The second socket comprises the second aperture and a third aperture in the element. Insertion of a prong of an electrical plug into the first aperture provides electrical communication between the prong and the first electrical conductor. Insertion of a prong of an electrical plug into the second aperture provides electrical communication between the prong and the second electrical conductor. Insertion of the first prong of the electrical plug into the third aperture provides electrical communication between the first prong and the third electrical conductor, when the second prong of the plug is in the second aperture. The receptacle further comprises a first hot line connected to the first conductor, a first neutral line connected to the second conductor, and a second hot line connected to the third electrical conductor. The first and second hot lines are each lighter than a 14 gauge wire or heavier than a 12 gauge wire. In some embodiments, the line size is at least as heavy as 10 gauge. In some embodiments, the electrical receptacle further comprises a first voltage having a first phase in the first hot line and a second voltage having a second phase in the second hot line. In some embodiments, the first and second voltages are out of phase by 180 degrees.

In some aspects, an electrical receptacle configured for delivering two-phase power is provided. The electrical receptacle comprises a first electrical conductor, a second electrical conductor, a third electrical conductor, and an element having first and second sockets each adapted to receive two circuit prongs of a standard-size electrical plug. The first socket comprises first and second apertures in the element. The second socket comprises the second aperture and a third aperture in the element. Insertion of a prong of an electrical plug into the first aperture provides electrical communication between the prong and the first electrical conductor. Insertion of a prong of an electrical plug into the second aperture provides electrical communication between the prong and the second electrical conductor. Insertion of the first prong of the electrical plug into the third aperture provides electrical communication between the first prong and the third electrical conductor; when the second prong of the plug is in the second aperture. The electrical receptacle further comprises a first hot line connected to the first conductor, wherein the first hot line is connected to a first voltage source producing a voltage with a first voltage phase, a first neutral line connected to the second conductor, and a second hot line connected to the third electrical conductor. The second hot line is connected to a second voltage source producing a voltage with a second voltage phase. In some embodiments, the first and second voltages are 180 degrees out of phase. In some embodiments, the electrical receptacle further comprises an oversized plug inserted into the first socket and an oversized plug inserted into the third socket. In some embodiments, the electrical receptacle further comprises a plug that is inserted into the receptacle, said plug comprising first, second, and third circuit prongs. The prongs are inserted into the first, second and third apertures of the receptacle. In some embodiments, the electrical receptacle further comprises a plug inserted into the receptacle. The plug has first and second prongs that fit into the first and third apertures on the receptacle and the distance between the first and second prongs is about twice the distance between two circuit prongs in a type A plug.

In some aspects, a method for providing two-phase power at an electrical receptacle is provided. The method comprises providing an electrical receptacle comprising a first electrical conductor, a second electrical conductor, a third electrical conductor, and an element having first and second sockets each adapted to receive two circuit prongs of an electrical plug. The first socket comprises first and second apertures in the element. The second socket comprises the second aperture and a third aperture in the element. The first aperture allows a first prong of an electrical plug to contact the first electrical conductor. The second aperture allows a second prong of the electrical plug to contact the second electrical conductor. The third aperture allows the first prong of the electrical plug to contact the third electrical conductor when the second prong of the plug is in the second aperture. The first electrical conductor is connected to a first voltage source producing a first voltage with a first phase. The third electrical conductor is connected to a second voltage source producing a second voltage with a second phase. The first and second phases are 180 degrees out of phase. In some embodiments, the method further comprises inserting a pair of circuit prongs of an electrical plug into the first and third apertures to simultaneously draw power from the first and third conductors. In some embodiments, the method further comprises inserting a first prong of an electrical plug into the first aperture and inserting a second prong of an electrical plug into the third aperture. In some embodiments, the method further comprises turning on a device that operates on 240 volts that is connected to the electrical plug. In some embodiments, the method further comprises drawing single phase power from the electrical receptacle. In some embodiments, the method further comprises providing the electrical plug which further comprises a neutral prong located between the first and second prongs. The method further comprises inserting the neutral prong into the second aperture and contacting the second electrical conductor, thereby supplying single phase power between the first and second and/or second and third conductors.

In some aspects, a method for providing 240 volt current is provided. The method comprises providing a first hot line to a first aperture in an electrical receptacle, providing a second hot line to a second aperture in an electrical receptacle. The first and second apertures are approximately twice as far apart as the distance between two apertures for a type A electrical plug. The method further comprises applying a first voltage having a first phase to the first hot line, applying a second voltage having a second phase to the second hot line. The first and second phases are about 180 degrees out of phase. The method further comprises drawing current from the first and second hot lines simultaneously.

In some aspects, an electrical receptacle is provided. The electrical receptacle comprises a first electrical conductor, a second electrical conductor, a third electrical conductor, an element having a first aperture, a second aperture, and a third aperture, wherein the first aperture allows a first prong of an electrical plug to contact the first electrical conductor, wherein the second aperture allows a second prong of the electrical plug to contact the second electrical conductor, wherein the third aperture allows the first prong of the electrical plug to contact the third electrical conductor, wherein the apertures are arranged and configured so that two circuit prongs of a standard-sized electrical plug can be inserted into the first and second apertures or the second and third apertures and a removable electrical jumper that is configured to electrically connect the first and third electrical conductors. In some embodiments, the jumper has a first end and a second end, wherein the first end has a conducting surface on both sides of the first end while the second end has a conducting surface on one side of the second end and an insulating surface on an opposite side of the second end. In some embodiments, the jumper further comprises a switch in the jumper. In some embodiments, the switch comprises two three-position switches.

In some aspects, a method of converting a TADS that is connected to a first circuit and a second circuit into a TADS that has an electrical property of either the first circuit or the second circuit is provided. The method comprises inserting a jumper having a first end comprising a first conducting member and a second end comprising a second conducting member and an insulting member into a TADS. The TADS comprises (a) a first conductor connected to a first wire, (b) a second conductor connected to a second wire and (c) a third conductor connected to a third wire. The first end of the jumper provides an electrical contact to the first wire and the first conductor in the TADS and the second end provides for an electrical contact between the first wire and first conductor to the third electrical conductor, but prevents an electrical contact between the third conductor and the third wire. In some embodiments, the method further comprises the steps of removing the jumper, rotating the jumper 180 degrees, and inserting the jumper into the TADS. The first end allows for an electrical contact to the third wire and the third conductor in the TADS. The second end provides for an electrical contact between the third wire and third conductor to the first conductor, but prevents an electrical contact between the first conductor and the first wire.

In some embodiments a plug receptacle for receiving an electrical plug in two orientations is provided. The receptacle comprises a first aperture in the receptacle for receiving a plug in a first orientation, a second aperture in the receptacle for receiving the plug in a second orientation, and a third aperture in the receptacle for receiving the plug in both the first orientation and the second orientation. The first and third apertures form a first socket. The second and third apertures form a second socket and the first and second orientations of the plug are different orientations. The can plug comprise two pins. The plug (and thus the type and spacing of the apertures of socket) can be selected from the group consisting of: NEMA 10-20, NEMA 10-30, NEMA 10-50, NEMA 14-30, NEMA 14-50, NEMA 6-15, NEMA 6-20, NEMA 6-30, NEMA 6-50, NEMA 2, Pin and sleeve circular connectors, IEC 60309, BS EN 60309-2, Type A plugs, NEMA 2-15, NEMA 2-20, JIS 8303, Class II, type B plug, NEMA 5-15, NEMA 5-20, NEMA 5-30, NEMA 5-50, NEMA 1-15, NEMA 5-15, Lewden plugs, Type C plugs, CEE 7/16, CEE 7-17, BS 4573, sockets, Type D, BS 546, Type E, French type E, Type F, CEE 7/4, Gost 7396, Type E & F hybrid, Tyep G, BS 1363, Type H, Type I, AS 3112, CPCS-CCC, IRAM 2073, Type J, SEV 1011, IEC 60906-1, Type K, Type L, CES 23-16/VII 10 A, CEI 23-16/VII 16 A, and Type Ma NEMA (National Electrical Manufacturers Association). The receptacle further comprises a first conductor located behind the first aperture, a second conductor located behind the third aperture, a jumper conductor electrically connecting the first and second conductors, and a third conductor located behind the second aperture.

In some aspects, an electrical jumper is provided. The electrical jumper comprises a first end comprising a first conducting member, a second end comprising a second conducting member and an insulating member, wherein the second conducting member is positioned on a first side of the second end and the insulating member is positioned on an opposite side of the second end, and an insulated body comprising a third conducting member and an insulated section. The body connects the first and second ends and the third conducting member is in electrical communication with the first and second conducting members. In some embodiments, the first, second, and third conducting members are formed of a single wire.

In some aspects, a power strip is provided comprising a TADS. In some embodiments the TADS comprises a first electrical conductor, a second electrical conductor, and an element having a first aperture, a second aperture, and a third aperture. The first aperture allows a first prong of an electrical plug to contact the first electrical conductor. The second aperture allows a second prong of the electrical plug to contact the second electrical conductor. The third aperture allows the first prong of the electrical plug to contact the first electrical conductor. The apertures are arranged and configured so that two circuit prongs of a standard-sized electrical plug can be inserted into either the first and second apertures or the second and third apertures. In some embodiments, a fourth aperture is positioned in a single line with the three apertures of the TADS. The fourth aperture is positioned so that it can accept the second prong of the electrical plug when the first prong of the electrical plug is inserted into the third aperture.

In some aspects, an extension cord comprising a TADS as the female end of the extension cord is provided.

In some aspects, a plug adapter is provided. The plug adapter comprises a first end having a first electrical prong and a second electrical prong. The first and second electrical prongs are positioned so as to be twice as far apart as the distance between current carrying prongs on a type A electrical plug. The adapter further comprises a second end configured to receive a 240 volt electrical plug. In some embodiments, the plug adapter further comprises a third electrical prong located between the first and second electrical prongs.

In one aspect, a receptacle, and particular uses and wiring arrangements thereof, are provided that allow for greater usability of the sockets in a receptacle. In some embodiments, the receptacle has sockets that share at least one aperture between two different sockets. This arrangement, having two separate sockets that share an aperture, results in the formation of a "linked socket," "dual socket," or a "TADS," tri-aperture, dual socket, receptacle.

In some aspects, the invention comprises a TADS that has a jumper between the first and third conductors of a traditional TADS (see, e.g., Ser. No. 11/050,081, U.S. Pat. Pub. No. 2005/0191902, filed Feb. 2, 2005, U.S. Pat Pub. No. 2006/0183352, filed Apr. 5, 2006, and U.S. Non-provisional application Ser. No. 10/509,563, U.S. Pat. Pub. No. 2005/0202689, filed Sep. 28, 2004; PCT App. No. IB03/01244, filed Apr. 4, 2003, Pub. No. WO 03/084819 for a description of certain embodiments of TADS and their uses), the entireties of all of which are incorporated by reference). This jumper makes the first and third conductors in the receptacle electrically equivalent. In some embodiments, this can effectively make all of the sockets of the TADS "electrically similar," as far as the current, voltage, or switchability characteristics of the sockets are concerned. However, the jumper makes possible different electrically equivalent plug-in orientations for how a particular plug is inserted into a receptacle. Thus, in some embodiments, the use of a TADS with oversized plugs (e.g., plugs with oversized adaptors or transformers), especially with polarized or grounded plugs, is contemplated. This can allow one to plug in more than one oversized plug into a receptacle.

In some aspects, the invention comprises a method of obtaining power from a first and a second socket at a TADS, where each socket can access a different circuit. This can allow a single TADS to supply power from two different circuits. In some embodiments, this is achieved while still having two sockets available for each circuit.

In some aspects, the invention comprises a TADS that is configured to allow two phase, 240 V, or single phase, 120 V, power to be obtained from the TADS. In some embodiments, this involves a specially adapted plug.

In some aspects, any one of the above TADS embodiments can be configured for the various electrical systems around the world, including, but not limited to receptacles that can accept any electrical plug, such as any listed herein or such as NEMA 10-20, 10-30, 10-50, 14-30, 14-50, 6-15, 6-20, 6-30, 6-50, NEMA 2, Pin and sleeve circular connectors, IEC 60309, and BS EN 60309-2, Type A plugs, NEMA 2-15, 2-20, JIS 8303, Class II, type B plug, NEMA 5-15, NEMA 5-20, 5-30, 5-50, NEMA 1-15, 5-15, Lewden plugs, Type C plugs, CEE 7/16, CEE 7-17, BS 4573, sockets, Type D, BS 546, Type E, French type E, Type F, CEE 7/4, Gost 7396, Type E & F hybrid, Type G, BS 1363, Type H, Type I, AS 3112, CPCS-CCC, IRAM 2073, Type J, SEV 1011, IEC 60906-1, Type K, Type L, CES 23-16/VII 10 A, CEI 23-16/VII 16 A, and Type M, for example. In particular, a TADS having a jumper between the first and third electrical conductors can have apertures configured and/or arranged for any of the above plugs. As will be appreciated by one of skill in the art, all that need be present is the shared current carrying aperture between two sockets.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

FIG. 1D depicts a traditional electrical socket and 1) an electrical plug in first and second orientations, 2) a polarized plug, and 3) a grounded plug.

FIG. 2O is an enlargement of section B in FIG. 2N

DETAILED DESCRIPTION OF THE PREFERRED EMBODIMENT

Despite changes in the nature of electrical devices, their power consumption requirements, their electrical plug configurations, and the frequency of use of electrical devices, little has been done to improve the device from which electricity is typically obtained, the electrical receptacle and the electrical plug. The present Inventor has recognized a variety of problems present in the art and has developed a number of solutions for making electrical receptacles, the electrical plugs associated therewith, and the wiring and use of the receptacles, generally more useful.

In many embodiments, these solutions generally involve particular embodiments or uses of a tri-aperture, dual socket (TADS) containing receptacle (e.g., a receptacle with three circuit forming apertures which can form two electrical sockets). Various embodiments of this device have been described in detail in U.S. application Ser. Nos. 11/050,081, filed February 2, and 10/509,563, filed Sep. 28, 2004, both incorporated by reference in their entireties. These receptacles involved at least three conducting members, which, when wired for use, remained electrically isolated from one another.

Figure 1A:
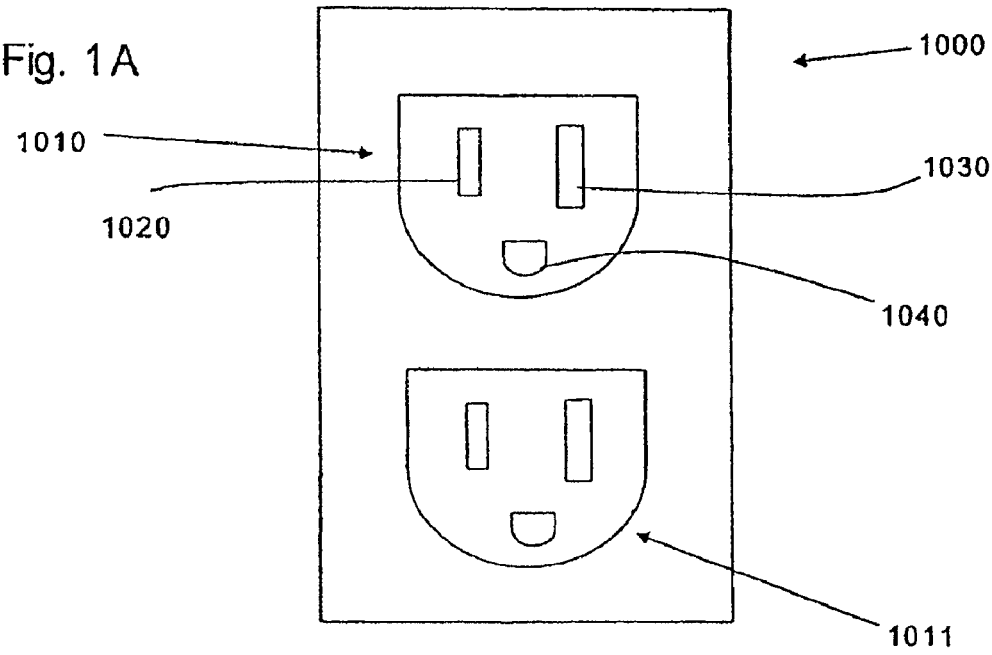
FIG. 1A depicts a traditional electrical receptacle.

FIG. 1A depicts a traditional "two aperture, single socket" set up that is currently commonly used in household receptacles. The electrical receptacle 1000 contains a socket 1010 which has multiple apertures, but which will only receive a polarized or grounded plug in a single orientation. The socket contains a first aperture 1020 and a second aperture 1030. Together these two apertures can allow the socket 1010 to receive a standard electrical plug (e.g., a Type A plug). As such, these apertures can be called, "socket forming apertures," "circuit forming apertures," "circuit apertures," etc., to designate that they are generally configured differently from a ground pin aperture 1040.

Typically, the first aperture 1020 allows a first circuit prong of an electrical plug to contact a "hot" conductor (which is typically part of a line that is eventually connected to an AC power source, which alternates, for example, between +120 and −120 V RMS [Root-Mean-Square]). The second aperture 1030 allows a second prong (or pin) of the electrical plug to contact a neutral conductor (which can be part of the same circuit, connected to a power source, but does not typically alternate between +120 and −120 V RMS and typically remains close to 0 V (although, as shown below in FIG. 5C, can provide current in some circumstances). Often, this second aperture is slightly larger than the first, allowing for the use of polarized plugs. In addition to these apertures, sockets can also contain ground apertures 1040. These ground apertures allow a ground prong from an electrical plug to contact a grounding conductor within the receptacle, which allows shorts or surges in power to be relatively harmlessly diverted from the circuit. However, these ground apertures are generally differently shaped from the "circuit" or "circuit-forming" apertures, generally do not have current flowing through them, and are not required for the actual use or formation of an electrical socket. Additionally, traditional receptacles 1000 often contain a second socket 1011; however, this second socket 1011, is completely separate from the first socket in that no apertures are shared between the two sockets.

Figure 1B:
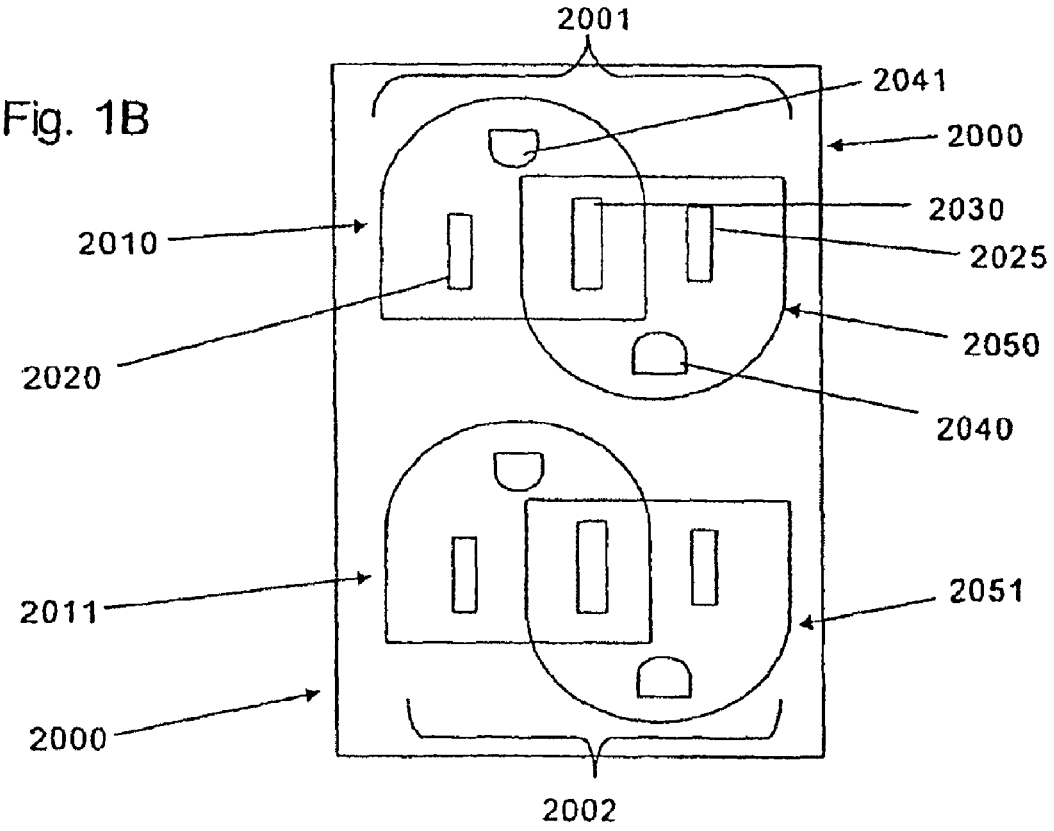
FIG. 1B depicts a tri-aperture, dual socket (TADS) receptacle. The receptacle contains two TADS.
Figure 1C:
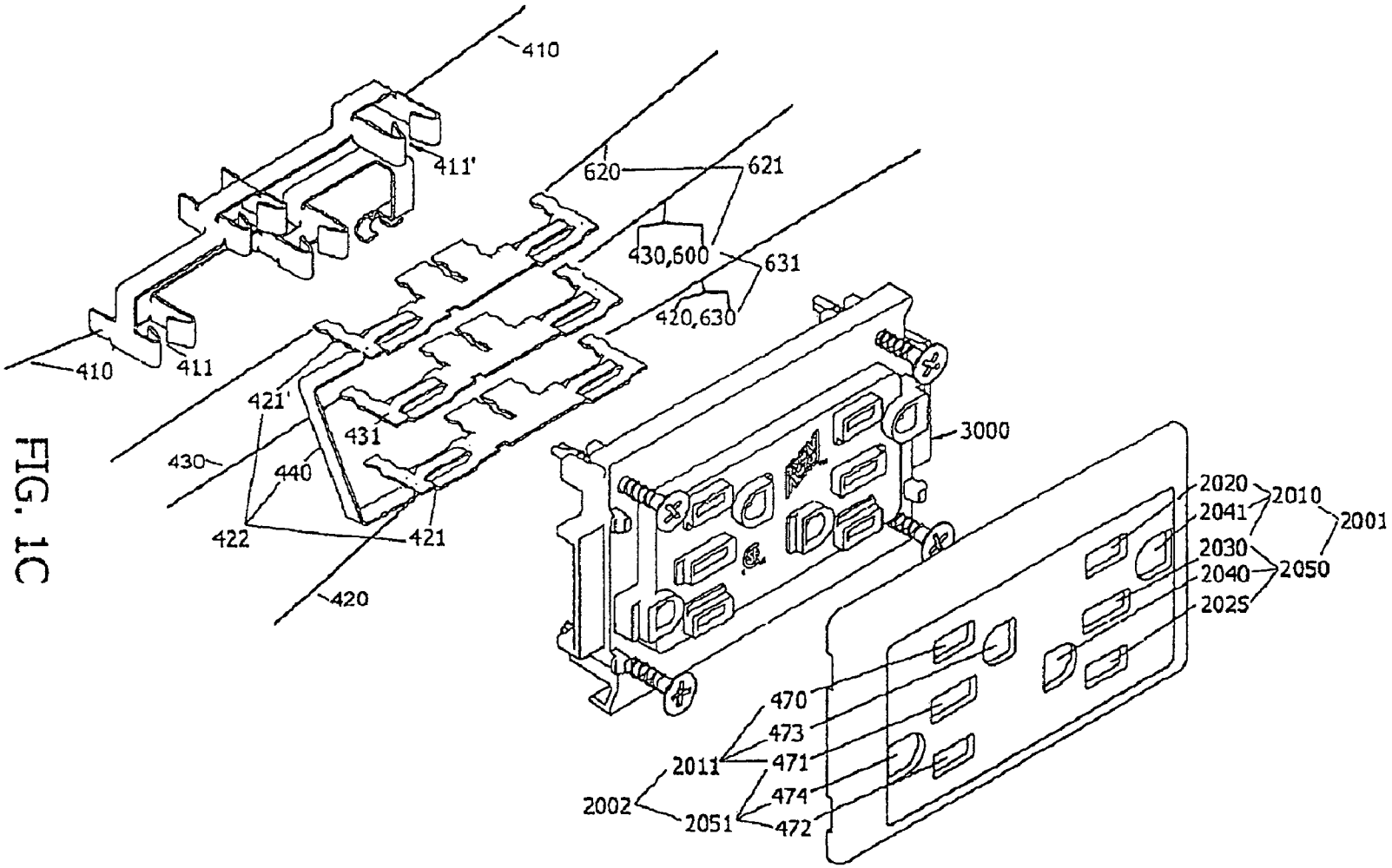
FIG. 1C depicts an exploded view of one embodiment of a TADS containing receptacle.

One embodiment of the tri-aperture, dual socket, (TADS) receptacle is depicted in FIG. 1B and FIG. 1C. In the TADS receptacle 2000, three apertures 2020, 2030, 2025 are arranged to form two sockets 2010 and 2050 in an element 3000 to form a TADS 2001. As above, there is a first socket 2010, which is formed by a first aperture 2020 and a second aperture 2030, which allow prongs of an electrical plug to pass there through to contact a hot and neutral conductor respectively. In addition, a second socket is formed and involves the same second aperture 2030 and a third aperture 2025 (which can again allow access to a second hot conductor). As above, the sockets can optionally contain ground apertures 2040 and 2041. Additionally, the electrical receptacle can also contain a second TADS 2002 having additional sockets 2011 and 2051.

While using a polarized plug has advantages, it restricts the orientations in which a plug can be plugged into a standard receptacle. This is not only generally restrictive, but, in situations in which one wishes to use large or bulky plugs (e.g., polarized transformer blocks/wall-warts or GFCI corded appliances) it can prevent the use of more than one plug in each traditional receptacle. Thus, in some embodiments, the tri-aperture dual socket receptacle is configured so that two large plugs can be used in a single electrical receptacle, even if the plugs are polarized. Such plugs (e.g., wall warts, plugs with transformers, etc.) can generally be referred to as "oversized" plugs.

In some embodiments, a tri-aperture receptacle provides the ability to deliver power from two independent circuits (e.g., each circuit on a separate breaker and therefore, when both provided at a single receptacle, able to deliver twice the current to the receptacle) to a receptacle in such a way so that one can use either or both circuits at the receptacle. In some embodiments, this has particular advantages in environments in which there is a high current requirement at one receptacle. It also provides flexibility so that one can simultaneously connect two plugs to any one of the two circuits or draw on both of those circuits at a single receptacle simultaneously. Previously, two different receptacles would have been installed, one for each circuit. In the present embodiment, a single TADS receptacle can provide multi socket access to two separate circuits, independently and simultaneously. Furthermore, selection of the circuit can be achieved simply by changing the orientation of the plug.

A TADS also provides the ability to deliver power at two-phase (or 240 V) or single-phase levels (120 V) power via a TADS or similar device. This can be achieved by the use of a specially developed electrical plug, described herein, and/or a particular wiring of the TADS.

As will be appreciated by one of skill in the art, some embodiments will contain all of these features. For example, when two independent circuits are delivered to a single TADS receptacle, and where the voltages are substantially out of phase (e.g., about 180 degrees), one can use the set up to 1) plug in two bulky polarized plugs, 2) plug in a specialized 240 V plug 3) plug in a standard electrical plug, and/or 4) plug in a first plug into a first socket to draw current from a first line and plug in a second plug into a second (or fourth) socket to draw current from a second line. Other embodiments can be directed to simply a subset of these aspects.

Each of the above embodiments, as well as various combinations and subparts thereof are discussed in more detail below.

Optional Orientation Sockets

For some sockets or receptacles, the orientation in which an electrical plug can be inserted into the outlet can be limited by the type of plug that is being used. For example, while a simple electrical plug with two identically shaped circuit prongs can be inserted into a socket in two different orientations (see FIG. 1D, showing a first orientation 401 and a second orientation 402), if the plug is polarized or has a grounding pin, the plug can only be inserted into the socket in a single orientation (see FIG. 1D, 403 and 404 respectively). While this can be limiting in certain situations, it becomes problematic when the plugs are large, such as in the case of "wall warts" (see, 450, FIG. 2A). Additionally, even if the plugs are not polarized, large or irregularly shaped plugs 405 can still benefit from the additional flexibility as far as plug placement is concerned, especially if the sockets are restrained by their placement next to a floor or a counter.

The TADS 2001 (FIG. 1C) allows one to have two different orientations 450 and 451 (FIG. 2A) that one can choose from to insert the plug into the socket(s). This is true even for polarized plugs or grounded plugs. Additionally, the TADS allow for a slight shifting (to the left or right in FIG. 2A) of the plugs by selecting a different sockets, if desired; thus, it can be useful for simple non-polarized plugs as well. For example, while socket 2010 and 2011 are aligned (FIG. 1B), socket 2051 is shifted to the right of both of the other sockets.

Figure 2A:
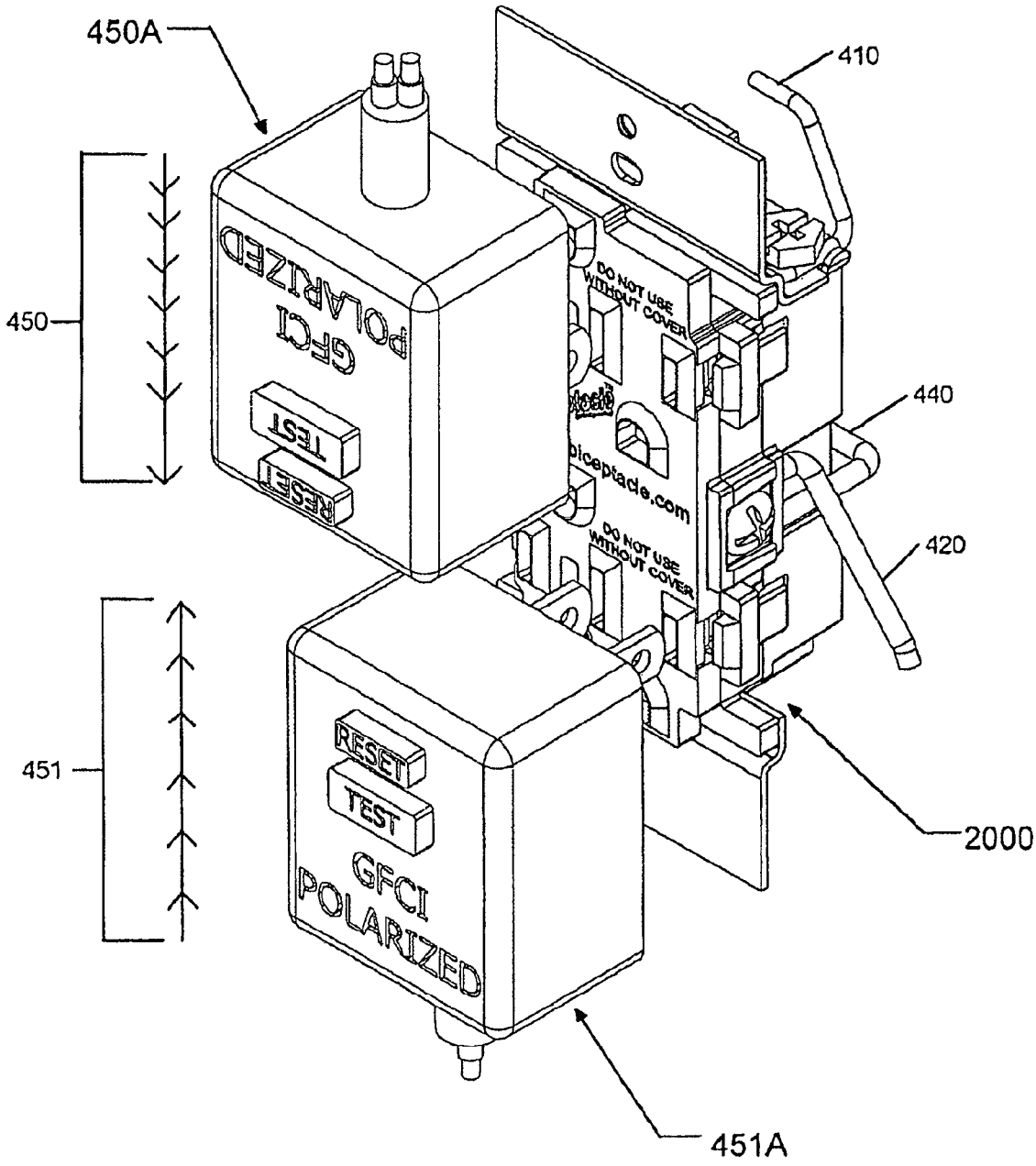
FIG. 2A is a depiction of set of TADS, in a single receptacle, allowing for the simultaneous use two oversized electrical plugs.

In some embodiments, when there are multiple tri-aperture dual sockets in an electrical receptacle, an added benefit is provided in that one can plug in more than one large plug into a single receptacle 2000. This is shown in FIG. 2A, where a first, large, polarized plug 450A is plugged into the first tri-aperture, dual socket, while a second, large, polarized plug 451A is plugged into a second tri-aperture, dual socket. If these two plugs were to be used in a traditional electrical receptacle 1000 of FIG. 1A, the first plug (as it is either polarized or contains a ground pin) would cover not only the top socket 1010, but due to the size of the plug, it would also cover part of the second socket 1011, preventing the second socket from being used. As can be observed in FIG. 2A, this need not be the case with the TADS arrangement.

Figure 2B:
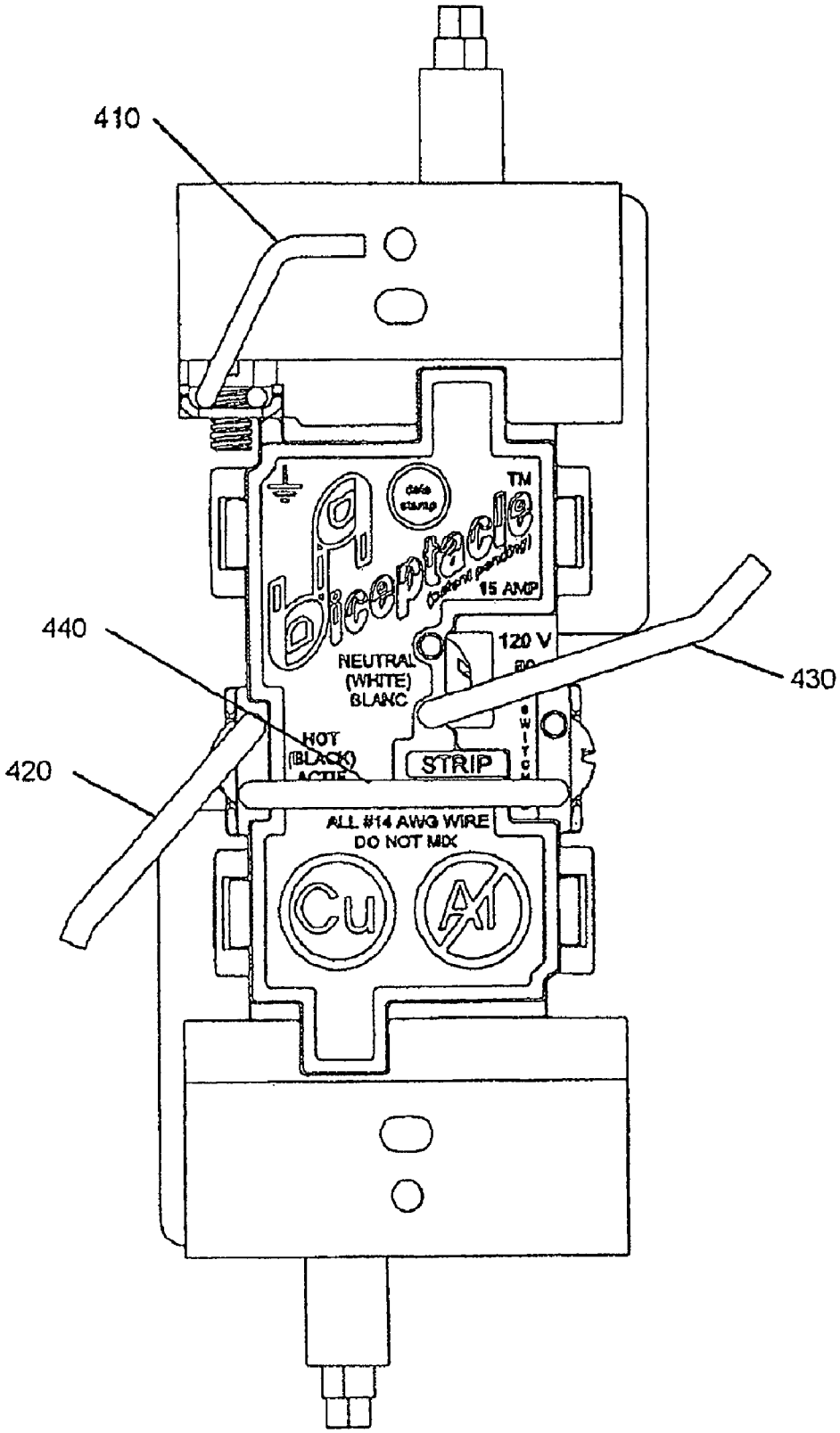
FIG. 2B is a depiction of one embodiment of a back surface of a TADS receptacle, in which a jumper is used to electrically connect a first and third conductors, which can be separate in some embodiments of the TADS.
Figure 2C:
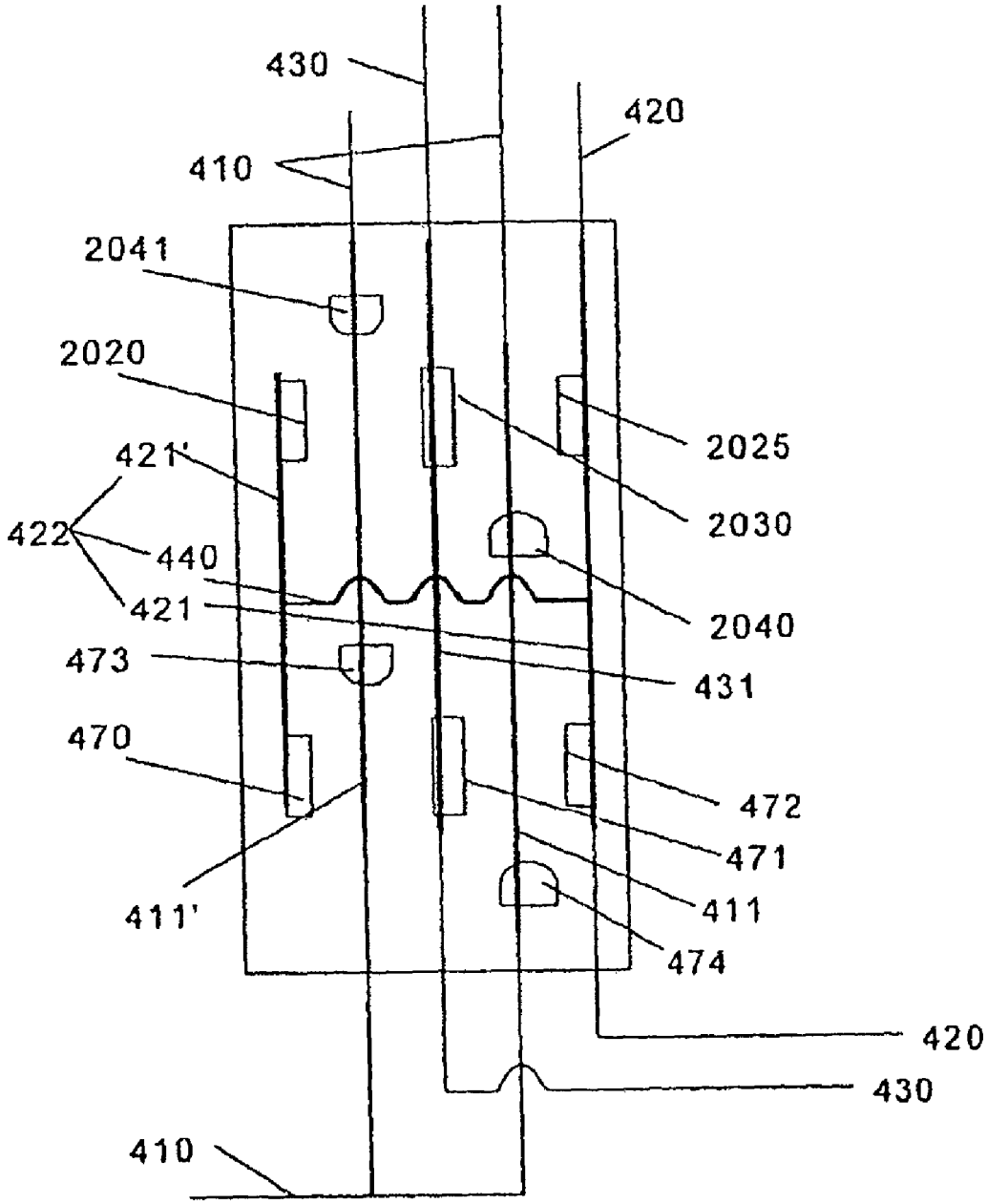
FIG. 2C is a diagram of the apertures, conductors, and wires of a TADS that has a jumper included in it.

While the arrangement of a TADS receptacle allows for the insertion of two large or oversized plugs in opposite orientations, the installation of a TADS receptacle can involve additional wiring that is not required in the present case. For the present method of use, there is an elegant solution for wiring or adapting a TADS receptacle so that both plugs are electrically equivalent, without having to add additional external wiring to the system. Such a modification is shown in FIG. 2B, FIG. 2C, and FIG. 1C. A jumper 440 is used to connect one conductor (shown in FIG. 2C as 421, connected to wire 420, behind aperture 2025) to another conductor (shown in FIG. 2C as 421' behind aperture 2020) so that this particular embodiment of the tri-aperture dual socket receptacle can go directly into a traditionally wired system, which requires only one hot wire 420 and one neutral wire 430, with an optional ground wire 410. FIG. 1C shows the jumper 440, connected to the first conductor 421' and the third conductor 421. Combined, each of these conducting sections make up a conductor 422 for this embodiment. The use of the jumper 440 allows the TADS to require connection only between two wires 420 and 430, provided with a 14/2 or 12/2 wiring system. This saves time, money, raw materials, and simplifies installation of the receptacle as well. In a preferred embodiment, the jumper, 440 directly connects the first and third conductors. In a preferred embodiment, the jumper connects the conductors without going through a switch. In this embodiment, a "conductor", as used for 421', 421, and 431 is a material that conducts electricity and is part of the receptacle. The conductor does not include the wire that goes from the receptacle to the power source or circuit, but rather, conductive elements that are part of the receptacle. In some embodiments, the conductors are wires located on the external body of the receptor (e.g., a jumper 440); however, they are separate from the hot, neutral, and ground lines or wires that are part of the circuit (until they are wired together, at which point they are in electrical communication).

Another representation of the conductor layout over the apertures is shown in FIG. 2C and FIG. 1C. In some embodiments, the electrical receptacle has one electrical conductor 422 (comprising elements 421, 440, and 421') and a second electrical conductor 431. The receptacle further has a first aperture 2020, a second aperture 2030, and a third aperture 2025. These apertures can be created in any structure, and thus are generally referred to as being created in an element 3000. The element can include a face plate or the face plate can be separate.

The first aperture 2020 allows a first prong of an electrical plug to contact the first electrical conductor 421' and the second aperture 2030 allows a second prong of the electrical plug to contact the second electrical conductor 431. In this tri-aperture dual socket, the third aperture 2025 allows the first prong of the electrical plug to contact the first electrical conductor 421, which due to jumper 440 is electrically equivalent to the first conductor 421'. The apertures 2020, 2030, and 2025 are arranged and configured so that a standard two prong electrical plug (e.g., type A) can draw current from the conductors 421' and/or 421 and the second conductor 431 through either the first and second apertures 2020 and 2030 or the second and third apertures 2030 and 2025, when the receptacle is wired in an electrical circuit.

In some embodiments, there need not be a separate or external jumper 440 and the conductor 422 (421', 421, and 440) can be a single piece of metal. In other embodiments, such as the one shown in FIG. 2C, the first conductor 422 comprises a first section (or segment) 421' aligned with the first aperture 2020; a separately formed second section 421 aligned with the third aperture 2025; and a separately formed third section 440 that is in electrical communication with the first section 421' and the second section 421 of the conductor 422. In some embodiments, the first conductor 422 is connected to a live or AC power source. In some embodiments, the second electrical conductor 431 is connected to a neutral power source.

In some embodiments, the electrical receptacle further comprises ground apertures. Such an embodiment can include a first ground aperture 2041, a second ground aperture 2040, a third conductor 411' and a fourth conductor 411. The first ground aperture 2041 is configured to receive a ground prong of a plug that is inserted into the first 2020 and second 2030 apertures. The second ground aperture 2040 is configured to receive a ground prong of a plug that is inserted into the second 2030 and third 2025 apertures. The first ground aperture 2041 exposes the third conductor 411', and the second ground aperture 2040 exposes the fourth conductor 411. As will be appreciated by one of skill in the art, the ground conductors 411 and 411' can be a single conductor, i.e., a unitary piece of conductive material.

In some aspects, the second aperture 2030 is configured to receive a polarized prong, and is therefore larger than the first or third apertures 2020 and 2025. The electrical receptacle can have an oversized plug in the first socket 2010 (FIG. 1B). In further embodiments, there is also an oversized plug in a fourth socket 2051. In further embodiments, at least one of the oversized plugs is polarized and/or grounded. In a further embodiment, both of the oversized plugs are polarized and/or grounded. As noted above, an "oversized" plug simply refers to a large plug that can be problematic with regard to its size. This is separate from the two-phase plug discussed below.

In some aspects, a method of using the tri-aperture dual socket (TADS) receptacle is provided. In some embodiments, the method allows one to provide power to at least one oversized electrical plug. The method can involve providing a TADS electrical receptacle (as in FIG. 2C and/or 1C), where the receptacle comprises an electrical conductor 422 (comprising elements 421, 421', and 440), a second electrical conductor 431, and an element 2000 or 3000 having a first aperture 2020, a second aperture 2030, and a third aperture 2025. As above, the first aperture 2020 allows a prong of an electrical plug 450A (FIG. 2A) in a first orientation 450 to contact the electrical conductor 422, and the second aperture 2030 allows the other prong of the electrical plug 450A in the first orientation 450 to contact the second electrical conductor 431. The third aperture 2025 allows a prong of the electrical plug 450A in a second orientation 451 to contact the electrical conductor 422. In some embodiments, the electrical conductor 422 can be described as the "first" electrical conductor or a "dual" conductor (although this does not mean that the conductor 422 has to be made from two or more pieces).

Once the receptacle is provided, the method can further involve inserting the prongs of an oversized electrical plug 450A into two apertures, e.g., 2020 and 2030 in a first orientation 450. The two apertures 2020 and 2030 form a first socket 2010. In some embodiments, the oversized plug 450A is large enough so that, had it been inserted into the second socket 2050 in the second orientation 451, it would have blocked some of socket 2051. Thus, the top of FIG. 2A demonstrates one embodiment of the appropriate plug and its insertion into the first socket of a TADS.

As discussed in more detail below, one can further insert a second plug 451A in a second orientation 451 into the apertures 471 and 472 (FIG. 2C) of a second TADS 2002 in the same receptacle 2000.

As will be appreciated by one of skill in the art, one need not insert both plugs at the same time to obtain the benefit of the method. For example, the top plug 450A in FIG. 2A can be inserted into the first and second apertures 2020 and 2030 in orientation 450, or into the second and third apertures 2030 and 2025 (still at the top of the electrical receptacle) in the second orientation 451. Of course, if the top plug 450A were inserted into the second and third apertures 2030 and 2025, on the top row of apertures 2001, in the second orientation 451, the plug and probably the power line from the plug would cover the lower set of apertures 2002 and sockets 2011 and 2051.

In some embodiments, the second aperture (2030 or 471) is configured to accept a polarized prong of an oversized electrical plug and the first and third apertures are positioned on either side of the second aperture (e.g., as shown in FIG. 2A).

In some embodiments, the method involves an electrical receptacle that further has a second TADS and thus a fourth aperture 470, a fifth aperture 471, and a sixth aperture 472. The fourth aperture 470, allows a prong from a second plug 451A to contact the electrical conductor 422. The fifth aperture 471 allows a second prong from the second plug 451A to contact the second electrical conductor 431, (when the plug 451A is in orientation 450). The sixth aperture 472 allows the first prong from the second plug 451A to contact the conductor 422 when the second prong from the second plug 451A is inserted into the fifth aperture 471 (and the plug 451A is in orientation 451). This method further involves inserting a set of prongs of a second oversized electrical plug 451A into the fifth 471 and sixth 472 apertures. In some embodiments, the first and second oversized plugs 450A and 451A are rotated 180 degrees with respect to one another. As will be appreciated by one of skill in the art, the plugs need not be rotated exactly 180 degrees in all embodiments. For example, where the electrical prongs of a plug (the circuit prongs) are not rectangular, the circuit apertures 2020, 2025, and 2030 need not be rectangular. In such an embodiment, the apertures can be, for example, circular or arranged off angle from one another (e.g., not parallel to each other). When the circuit apertures are circular, the three apertures of the dual socket will not inherently need to be in a single line (180 degree straight line between the three apertures) and can instead be greater or lesser than 180 degrees (two lines formed between the three apertures).

In some embodiments, the fourth aperture is configured to receive a polarized prong of an electrical plug. In a preferred embodiment, the second aperture 2030 and fifth aperture 471 (both circuit apertures) are configured to receive a polarized prong).

In some embodiments, the electrical receptacle further comprises a first ground aperture 2041, a second ground aperture 2040, a third ground aperture 473, a fourth ground aperture 474, or any subcombination thereof. Thus, in such an embodiment, and use of an embodiment, when a grounding prong of a first plug 450 is inserted into the first ground aperture 2041, allowing the plug (or oversized plug) to occupy the left-hand side of the upper TADS 2001 (socket 2010) in a first orientation 450, a second plug (or oversized plug) with a grounding prong can then be inserted into the fourth ground aperture 474 and the circuit prongs of the plug can be inserted into the right hand side of the second TADS 2002 (socket 2051) in a second orientation 451. Thus, the method allows two oversized polarized or grounded plugs to be inserted into a single electrical receptacle.

As will be appreciated by one of skill in the art, in embodiments when the electrical plug is large, but not necessarily huge, other methods of inserting and arranging plugs in the receptacle can be used. For example, instead of sockets 2010 and 2051 being used, sockets 2050 and 2011 can be used. Such a use may be especially advantageous where the cord from the electrical plug comes out of the plug at 90 degrees from the orientation of the prongs of the plug (e.g., in a manner similar to that shown in 451A in FIG. 2A, but where the body of the plug is much smaller. With such plugs, because of the placement of the cord, a plug inserted into socket 2050 could obstruct socket 2051. However, because the cord is flexible, socket 2011 can still be used and the respective cords will simply pass over the unused aperture in each TADS.

As will be appreciated by one of skill in the art, the method can be used with any type of combination of plugs. For example, a wall-wart (transformer) type with polarized plug, transformer type with non-polarized plug, a polarized plug, a non-polarized plug, a grounded plug of any of the previous plug types, a slightly oversized plug, etc. Additionally, for example, a non-polarized plug can be combined with a wall-wart or a polarized wall-wart or a grounded wall-wart. Additionally, depending upon the placement of the receptacle, the use of at least one TADS 2002, can be advantageous for any type of oversized plug (e.g., polarized, grounded, or non-polarized). For example, if the receptacle is located in a corner or at base of a wall, the lower TADS (or normal socket) may have a socket 2051, which may not be able to be used with a large plug. However, having the second orientation available in the other socket 2011, allows the lower level of sockets to be used as well.

The U.S. plug type is simply being used as an example. As will be appreciated by one of skill in the art, other plug-types will require different appropriate aperture and aperture configurations (discussed in more detail below). However, for most embodiments, the concept of two sockets sharing three circuit apertures (e.g., 2020, 2030, and 2025) will allow one of skill in the art to recognize the present embodiments of these inventions.

In some embodiments, the TADS arrangement is used on a power strip. In such an embodiment, at least one and preferably more than one TADS is used to allow large or irregularly shaped electrical plugs access to the sockets on the TADS. The multiple TADS can be arranged in a variety of manners. For example, the TADS can be arranged as a "computer power strip" or linearly so that the first three apertures of the first TADS form a line, which is continued by the next TADS and so on. Indeed, the following TADS can share apertures with the previous TADS, as appropriate. That is, this allows for not only the second aperture 2030 to be shared by two sockets, but also the first and third apertures 2020 and 2025 between TADS can be overlapped and thus removed if so desired. Alternatively, the power strip can have one TADS on a first side of the device and a second TADS on a second side of the device. In some embodiments, the first and second sides are opposite sides. In some embodiments, the TADS are arranged in parallel lines (meaning a line formed by the three apertures of a first TADS are parallel to a line formed by the three circuit apertures of a second TADS) but the lines do not overlap. In some embodiments, a first TADS can share grounding pin apertures with a second TADS. In some embodiments, a line of TADS is oriented perpendicularly to the line of the circuit apertures formed by the three apertures in each TADS. That is, the first TADS will have first, second, and third circuit apertures that form a first line, while a second TADS will have a first aperture, directly above or below the first aperture of the first TADS, and oriented perpendicularly to the first line. Similarly, the second aperture of the second TADS will be positioned above or below the second aperture of the first TADS, and the third aperture of the second TADS will be positioned above or below the third aperture of the first TADS, both of the second and third apertures of the second TADS being oriented perpendicularly to the first line. In some embodiments, a TADS is placed on the end of an extension cord in the place of a standard socket.

As will be appreciated by one of skill in the art, one need not insert two oversized plugs into a TADS receptacle to obtain some of the benefits from the above embodiments. At one level, the TADS arrangement disclosed above allows for one to insert an oversized plug without blocking another socket.

Figure 2D:
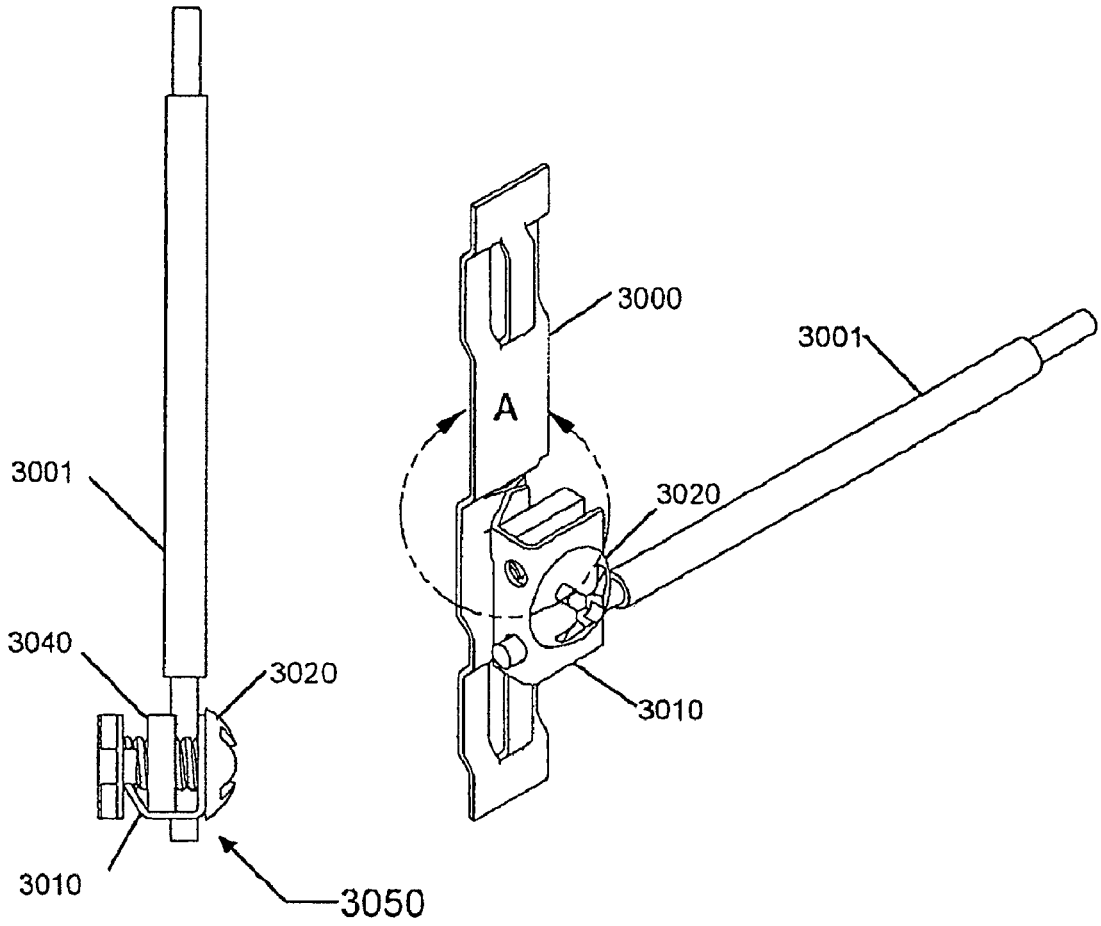
FIG. 2D is a diagram of a wire connected to an electrical conductor 3000 of a TADS.
Figure 2E:
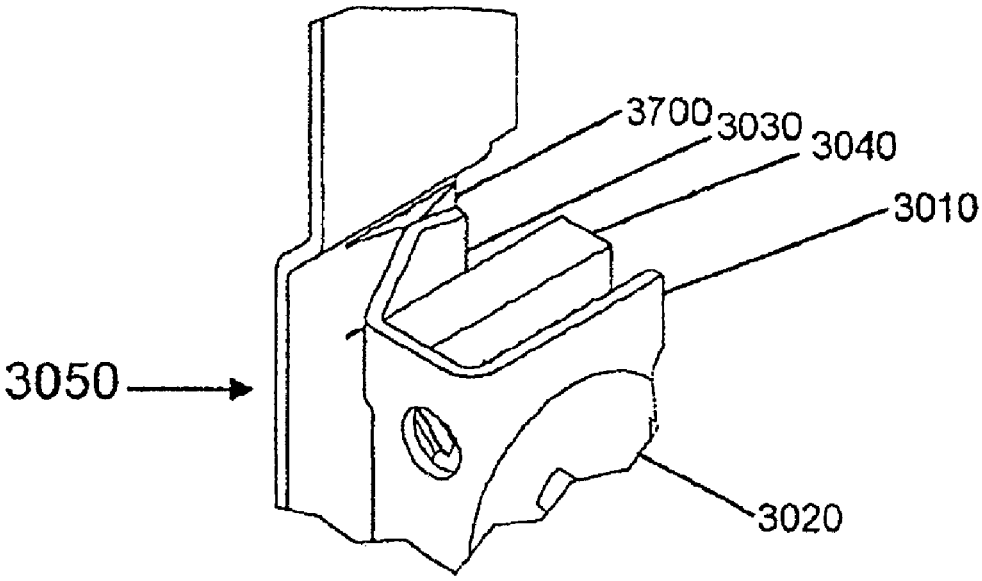
FIG. 2E is an enlargement of section A in FIG. 2D.
Figure 2F:
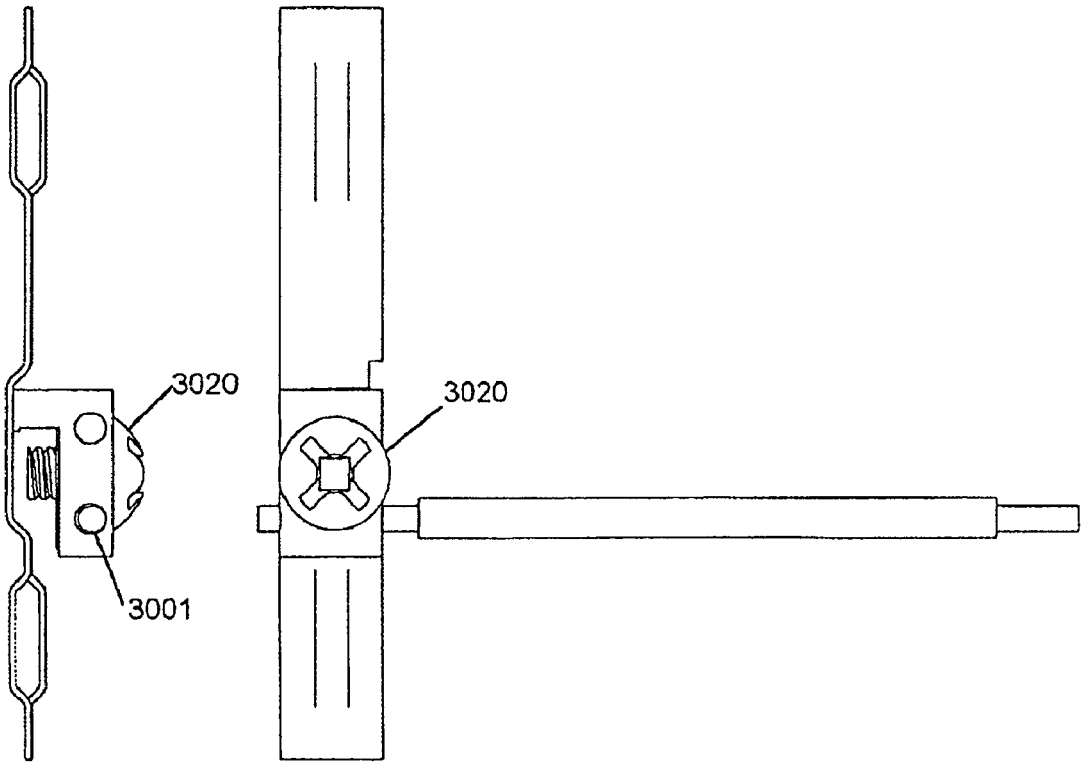
FIG. 2F is a diagram depicting two different perspectives of part of a clamp, an electrical conductor, and a wire.

While one of skill in the art will appreciate that there are a number of ways to connect electrical wires to the electrical conductors in the TADS receptacle, an exemplary arrangement is depicted in FIGS. 2D-2F. For example, a clamp 3050 can be used to connect a wire 3001 to an electrical conductor 3000. The clamp 3050 can include a wire clamping nut 3040, a spring termination 3010, and a wire clamping screw (or bolt) 3020 that connects the two, allowing for one to clamp a wire between the nut 3040 and the spring terminator 3010, as shown in FIG. 2D. The spring termination 3010 can have a spring arm 3030 that can contact the electrical conductor 3000. FIG. 2E is an enlarged view of section A in FIG. 2D. The wire clamping nut 3040 can have grooves or channels in it for placing the wire. The channels can be configured to allow for greater clamping ability, e.g., the surface of the channel(s) can have teeth or be roughened. In some embodiments, there are spring contacts on the electrical conductors to allow for better contact between the spring arm and the spring terminator 3010.

Figure 2G:
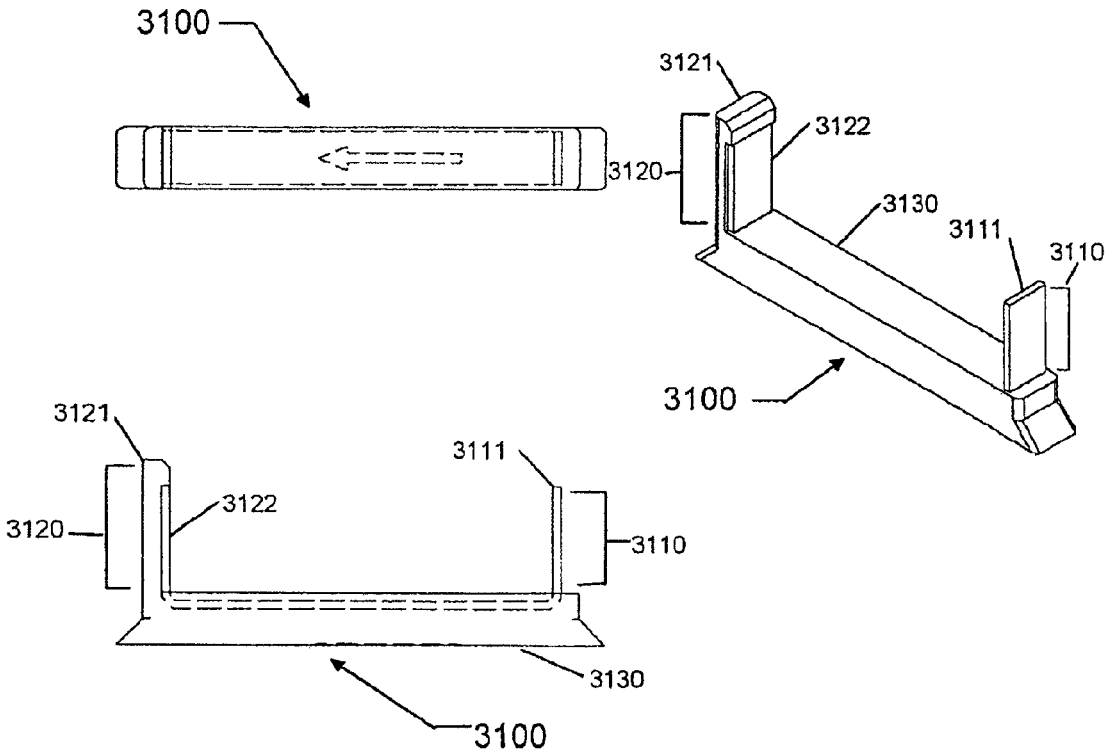
FIG. 2G is a diagram depicting one embodiment of a jumper from three different perspectives.

As noted above, the jumper 440 can be a simple wire. However, in some embodiments, there are additional structural features to the jumper for additional functionality. For example, FIG. 2G, shows one embodiment of an asymmetric jumper 3100 that has different structural features at each end 3120 and 3110 of the asymmetric jumper. At a first end 3120 of the asymmetric jumper 3100, there is an outer insulating member 3121 and an inner conducting member 3122. At the second end of the asymmetric jumper 3110, there is simply a conducting member 3111. As shown in FIG. 2G, the two conducting members 3122 and 3111 are conductively connected. The asymmetric jumper can also include an insulated body 3130, which can serve much the same purpose as the insulation on a wire. However, it can also allow for ease of use and manipulation of the asymmetric jumper 3100.

In some embodiments, the asymmetric jumper 3100 can allow for one to select which wires (e.g., 3401-3403) or circuits are connected to various electrical conductors (3301-3303) simply by changing the orientation of the asymmetric jumper 3100. This is demonstrated in FIGS. 2H-2J and FIGS. 2L-2O.

In a first orientation (FIG. 2J) the asymmetric jumper 3100 is connected by the first end 3120 to a first clamp 3050*a*. The first clamp 3050*a* is connected to a first electrical conductor 3301, but is electrically isolated from the first electrical conductor 3301. The first clamp 3050*a* is clamped onto a first wire 3401. An enlargement of this is shown in FIG. 2K. As can be clearly seen in the enlargement, while the conducting member 3122 contacts the first electrical conductor 3301, thereby serving as a asymmetric jumper between the third and first electrical conductors 3303 and 3301, the insulating member 3121 prevents contact between the spring termination 3010 (which is connected to the wire 3401) and the first electrical conductor 3301.

Figure 2H:
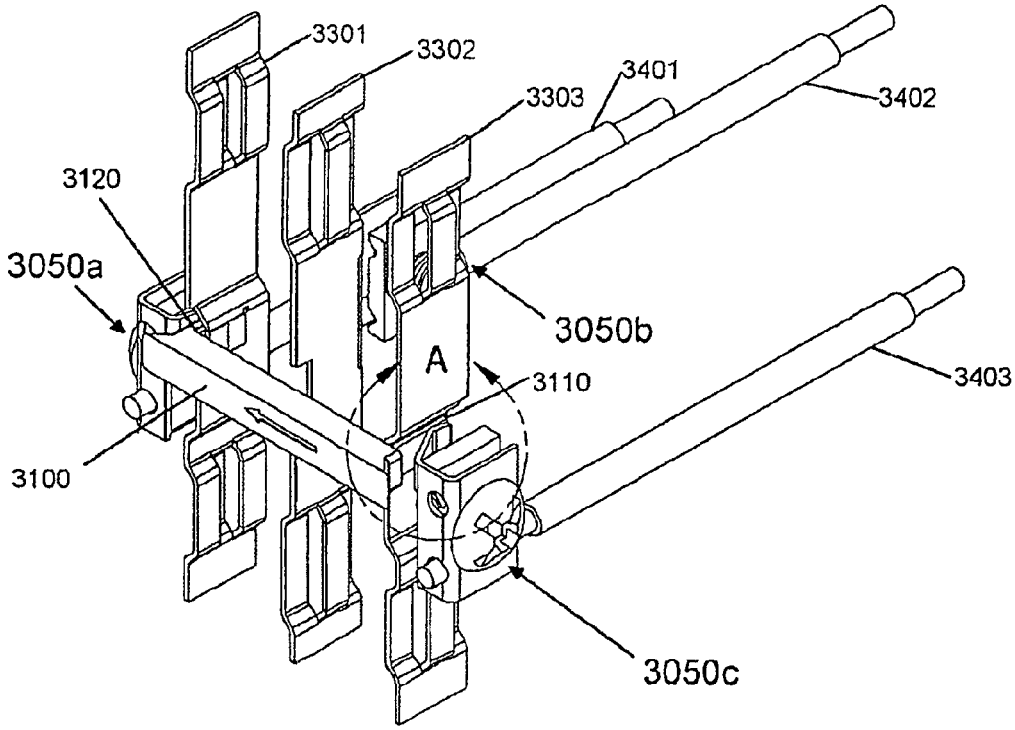
FIG. 2H is a diagram of one embodiment for how the electrical conductors of a TADS, wired to two different circuits, can, via the insertion of a single jumper, be converted into a TADS with the properties of one of the circuits.
Figure 2I:
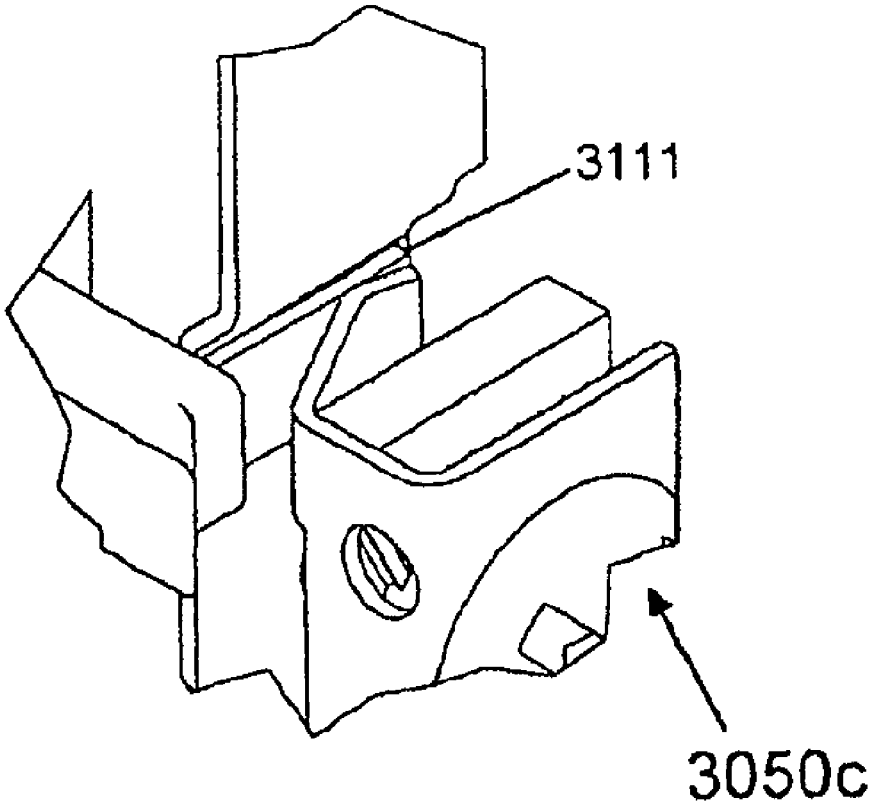
FIG. 2I is an enlargement of section A in FIG. 2H.
Figure 2J:
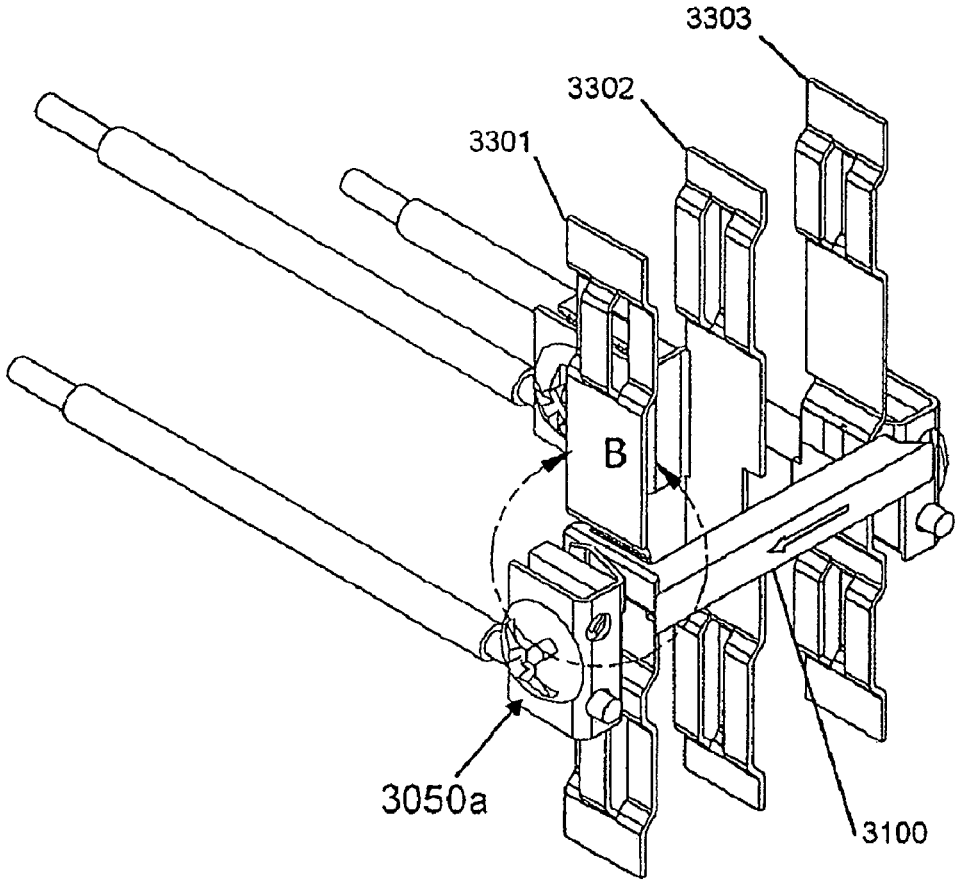
FIG. 2J is a depiction of the embodiment in FIG. 2H in which the entire device has been rotated 180 degrees.
Figure 2K:
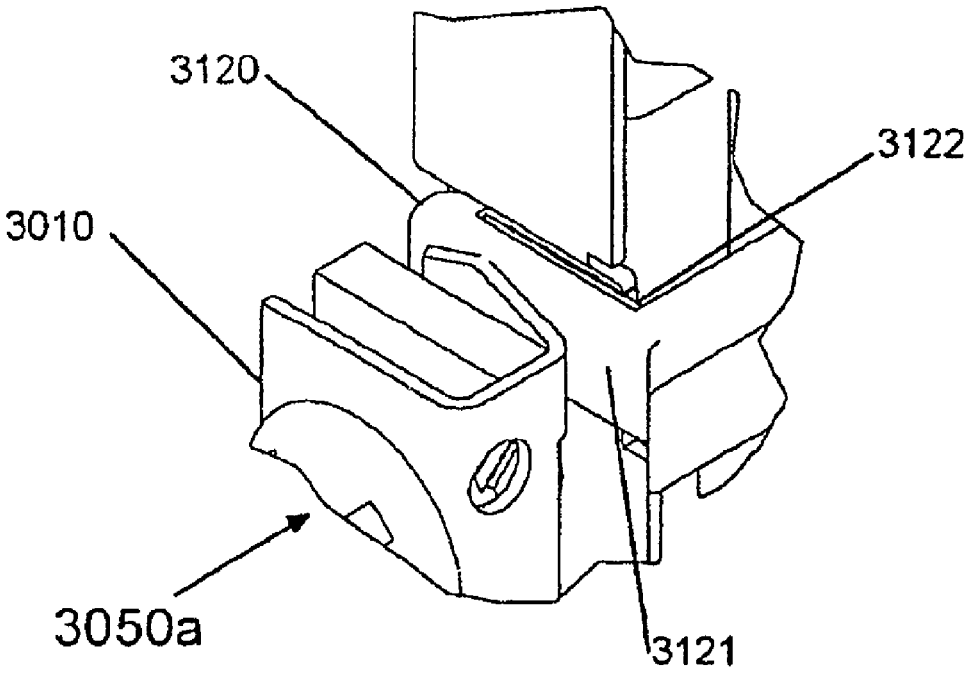
FIG. 2K is an enlargement of section B in FIG. 2J

As shown in FIG. 2H, the second end of the asymmetric jumper 3110 is connected to a third clamp 3050*c* that is conductively connected to the third electrical conductor 3303 and a third wire 3403. An enlargement of this is shown in FIG. 2I. As shown, the conducting member 3111 makes contact with the spring termination 3010 and the third electrical conductor 3303.

The asymmetric jumper is not connected to the second conductor 3302 or the second wire 3402 (which can be a neutral wire). As such, the electrical properties of both sockets in the TADS will be controlled by the electrical properties of wires 3403 and 3402.

Figure 2L:
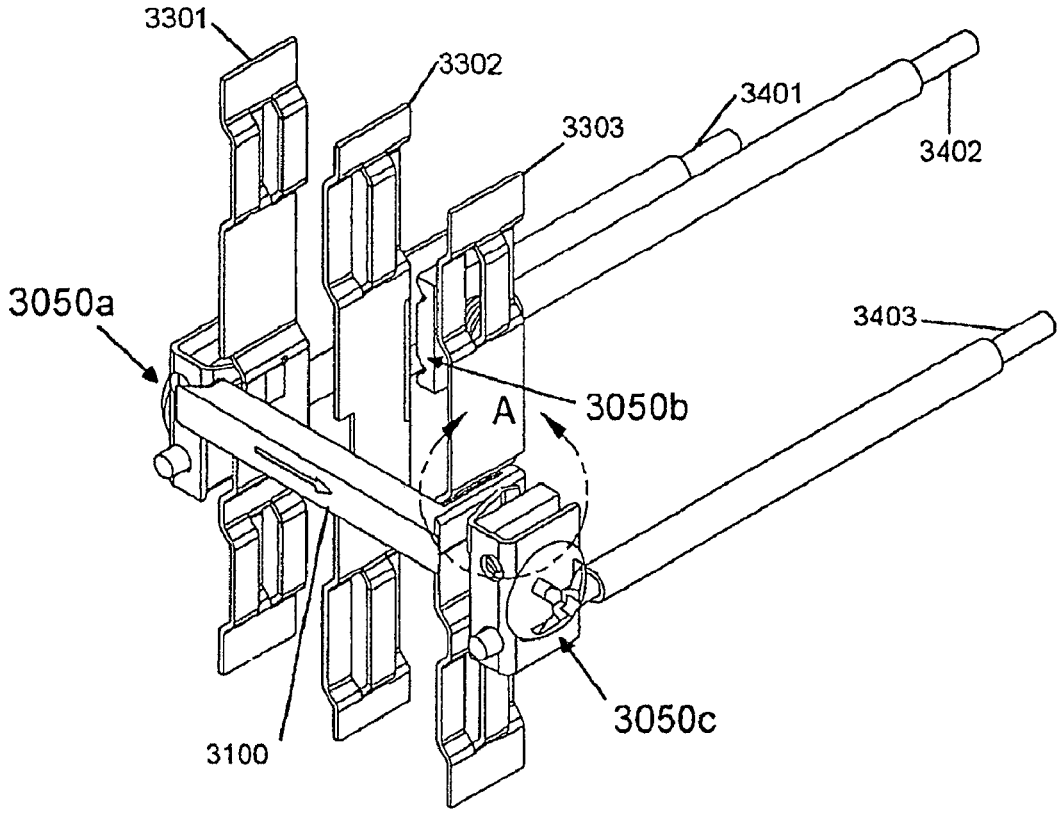
FIG. 2L is a diagram of the electrical conductors of the TADS in FIG. 2H, in which the jumper has been rotated 180 degrees and reinserted.
Figure 2M:
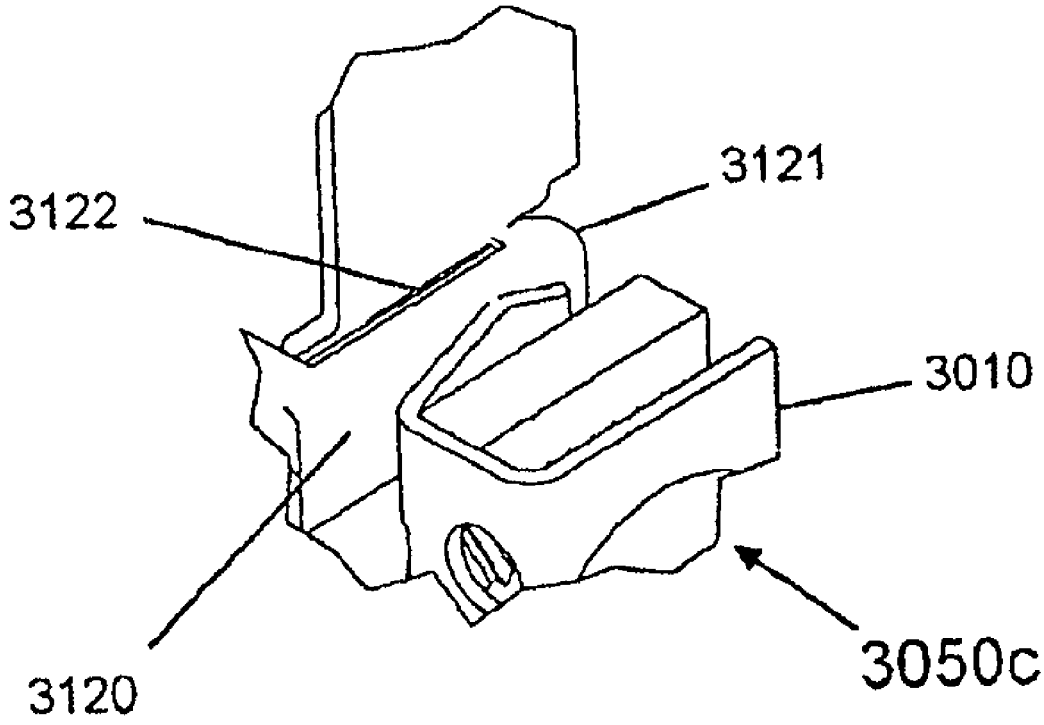
FIG. 2M is an enlargement of section A in FIG. 2L

In the second orientation, shown in FIGS. 2L-2O, the asymmetric jumper 3100 is flipped 180 degrees and reinserted into the collection of electrical conductors. As shown in FIG. 2L, the asymmetric jumper 3100 contacts, via a first end 3120, a third clamp 3050*c*. The third clamp 3050*c* is connected to a third electrical conductor 3303, but is electrically isolated from the third electrical conductor 3303. The third clamp 3050*c* is also clamped to a third wire 3403. An enlargement of this is shown in FIG. 2M. While the conducting member 3122 can contact the electrical conductor 3303, thereby serving as a jumper between the first and third electrical conductors, the insulating member 3121 prevents contact between the spring termination 3010 and the conducting member 3122. As such, the clamp 3050*c*, the spring termination 3010 (especially the spring aim 3030) and the wire 3403, are electrically separated from the third electrical conductor 3303.

Figure 2N:
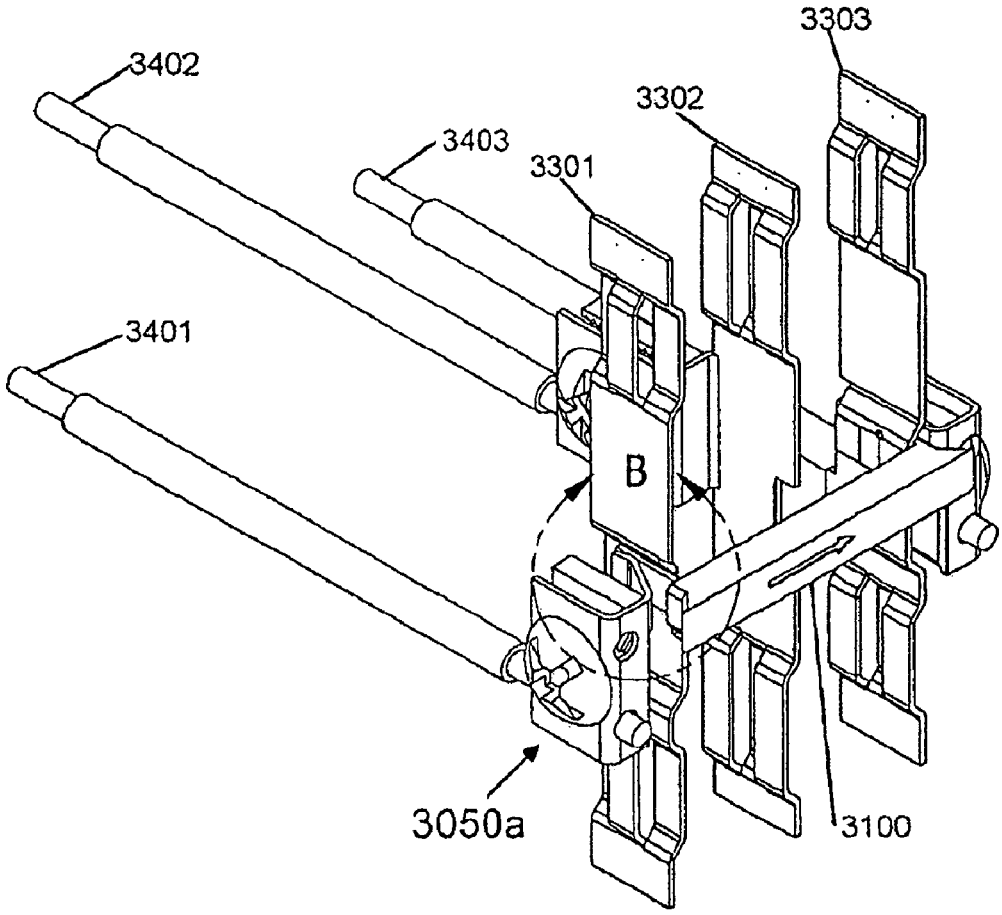
FIG. 2N is a depiction of the embodiment in FIG. 2L in which the entire device has been rotated 180 degrees
Figure 20:
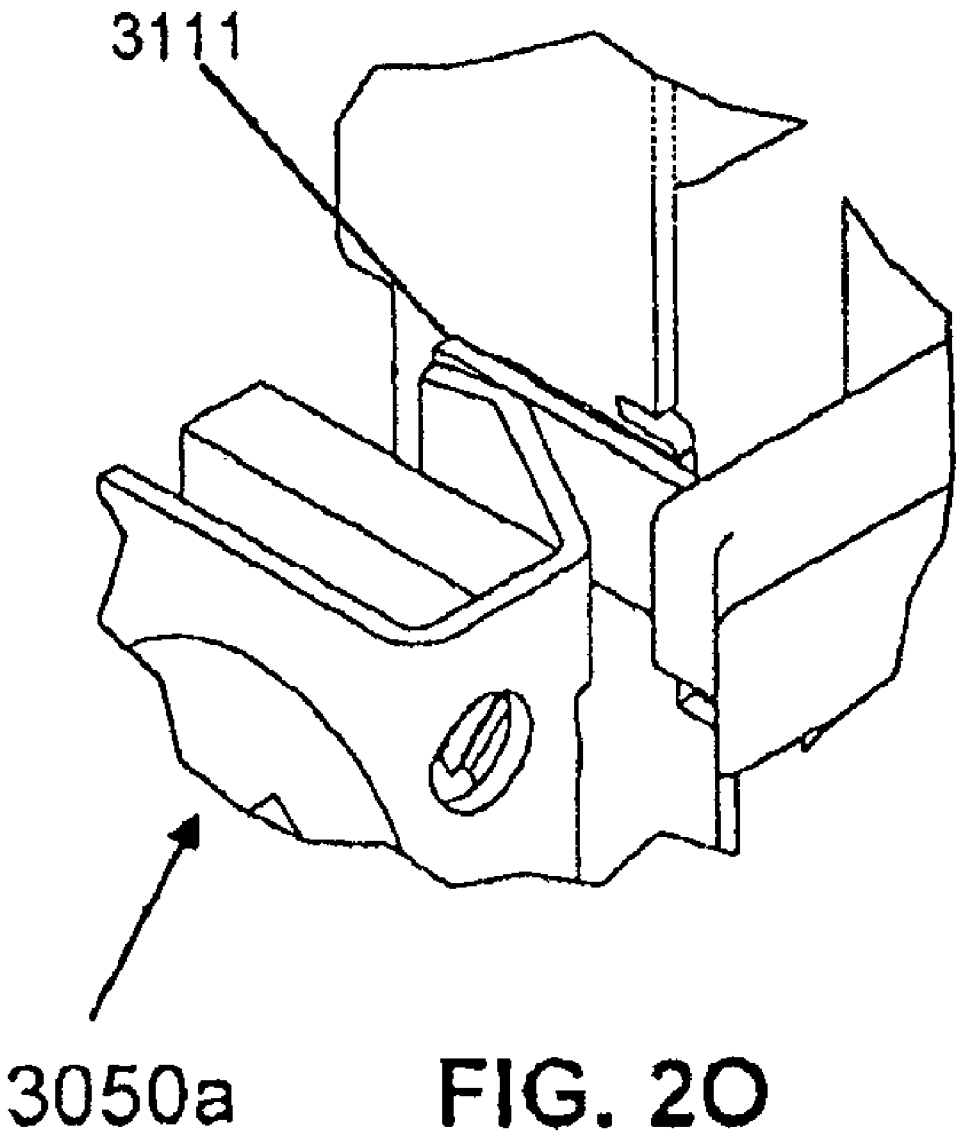

As shown in FIG. 2N, the conducting member 3111 on the opposite end of the asymmetric jumper 3110 is inserted into the device between the first electrical conductor 3301 and the spring arm 3030 of the first clamp 3050A. As shown in FIG. 2O, the conducting member can make contact with both the spring arm 3030 (and thus electrical contact with the wire 3401) and the first electrical conductor 3301. Thus, the first electrical conductor 3301 will be in electrical contact with the wire 3401, via the spring arm 3030.

In this second orientation, the electrical properties of the various electrical conductors 3301-3303 (or the TADS) will be controlled by the first and second wires 3401 and 3402. Thus, by flipping the asymmetric jumper 3100 one hundred and eighty degrees, one can switch between a set of TADS that work according to wires 3403 and 3402 to one that works according to wires 3402 and 3401. This can be especially advantageous in embodiments in which, for example, 3401 is switched and 3403 is not. The use of the asymmetric jumper 3100 can allow one to create a set of TADS in which both sockets will have the same properties. Of course, without the jumper, one will have the electrical properties of the first and second electrical conductors 3301 and 3302 controlled by wires 3401 and 3402, while the second and third electrical conductors 3302 and 3303 will be controlled by wires 3402 and 3403.

In some embodiments, the electrical conductor 3000 can have a spring 3700 (FIG. 2E), opposing the spring arm 3030 from the clamp 3050, to allow pressure to be applied to the conducting 3111 and conducting/insulating members 3121/3122 of the asymmetric jumper 3100. Such an embodiment can also allow for ease of insertion of the ends 3120 and 3110 of the asymmetric jumper 3100 into the rest of the device.

Figure 2P:
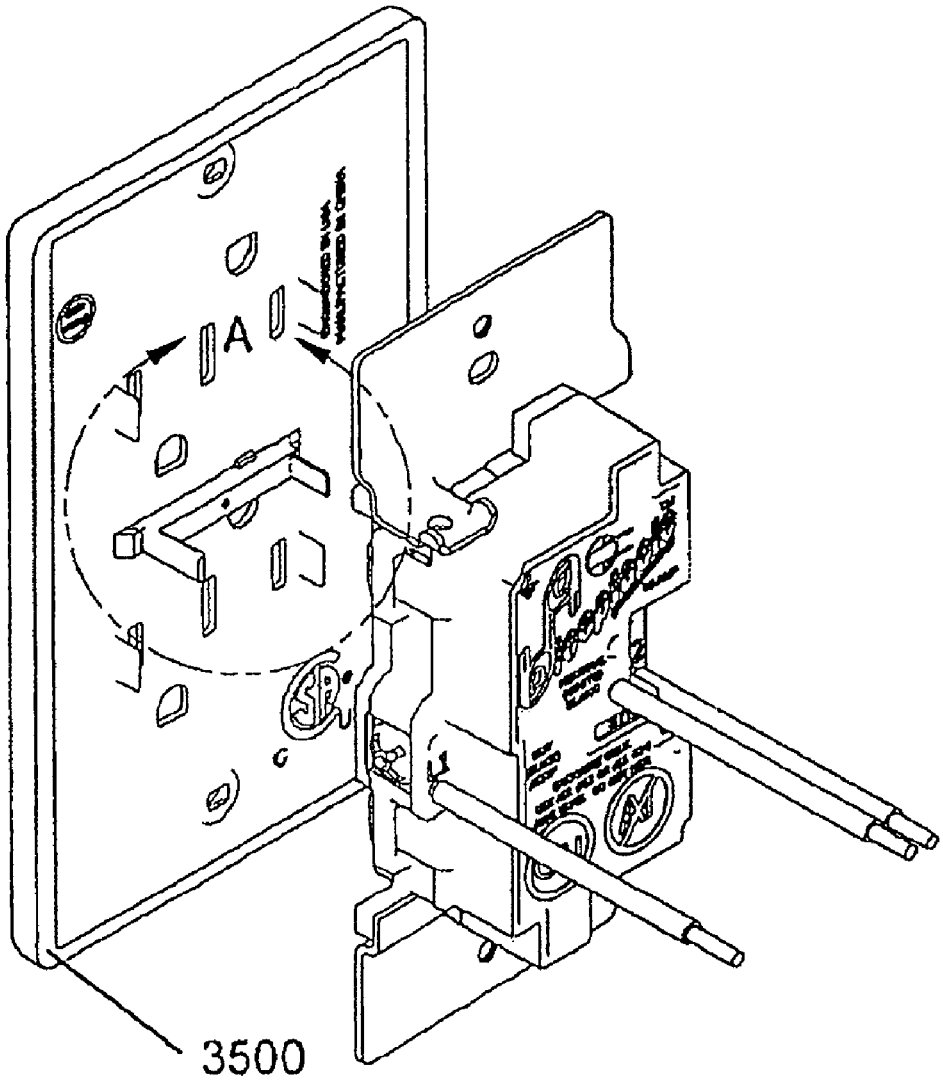
FIG. 2P is a diagram of how a cover plate can be positioned relative to the jumper and TADS.
Figure 2Q:
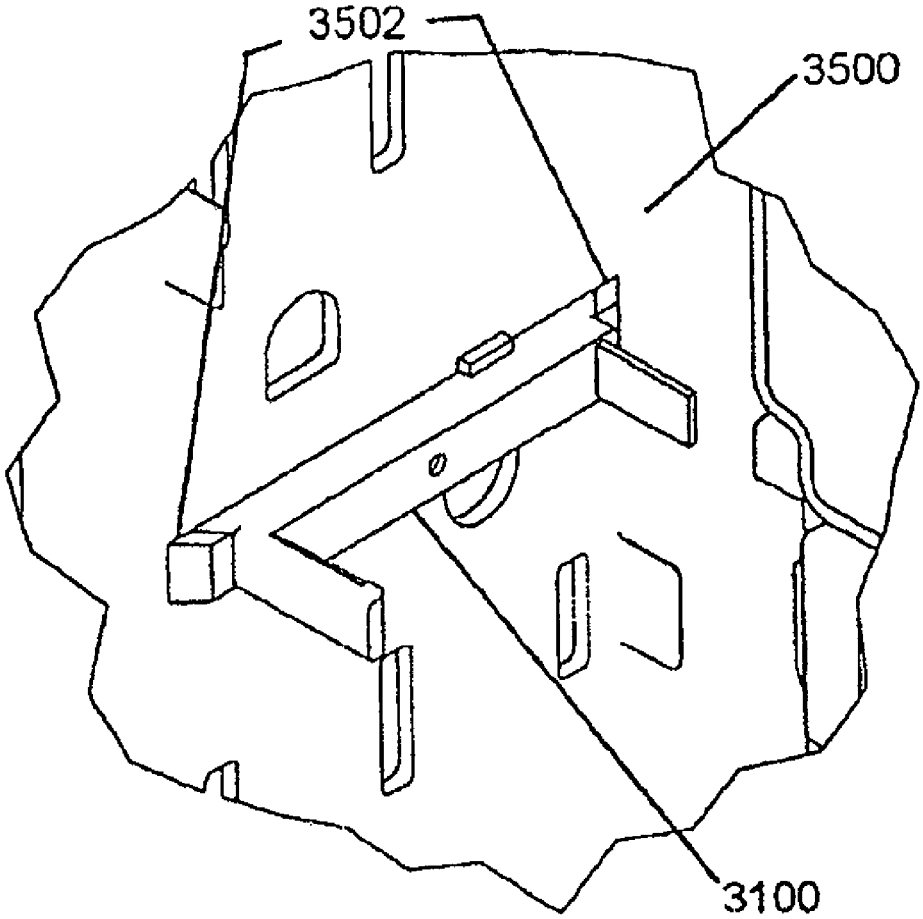
FIG. 2Q is a diagram of how the cover plate can be used to position the jumper for insertion into the TADS.

In some embodiments, the jumper is kept in place by the pressure exerted by the spring arm 3030 or the spring arm 3030 and the spring 3700. However, the jumper can be positioned by other devices as well. For example, FIGS. 2P and 2Q depict a cover plate 3500 with hooks 3502 on the internal side of the cover to which the jumper 3100 can be attached. The placement of the cover plate 3500 over the TADS allows for the insertion of the jumper into the device at the appropriate location (preventing electrical contact between a wire and an electrical conductor on one side while allowing electrical contact between a different wire and a difference electrical conductor on the other side). In some embodiments, the jumper is a part of the cover plate 3500 and one can rotate the entire plate 180 degrees in order to have a TADS that has the electrical properties of the first and second wires or the second and third wires. As will be appreciated by one of skill in the art, while some embodiments of the jumper 3100 can be especially useful when the two hot electrical conductors in a TADS are connected to different circuits (e.g., a switched and unswitched circuit), the jumper 3100 can also work like a simple jumper if it is used with a TADS in which only two wires (a hot and a neutral) are connected.

Figure 2R:
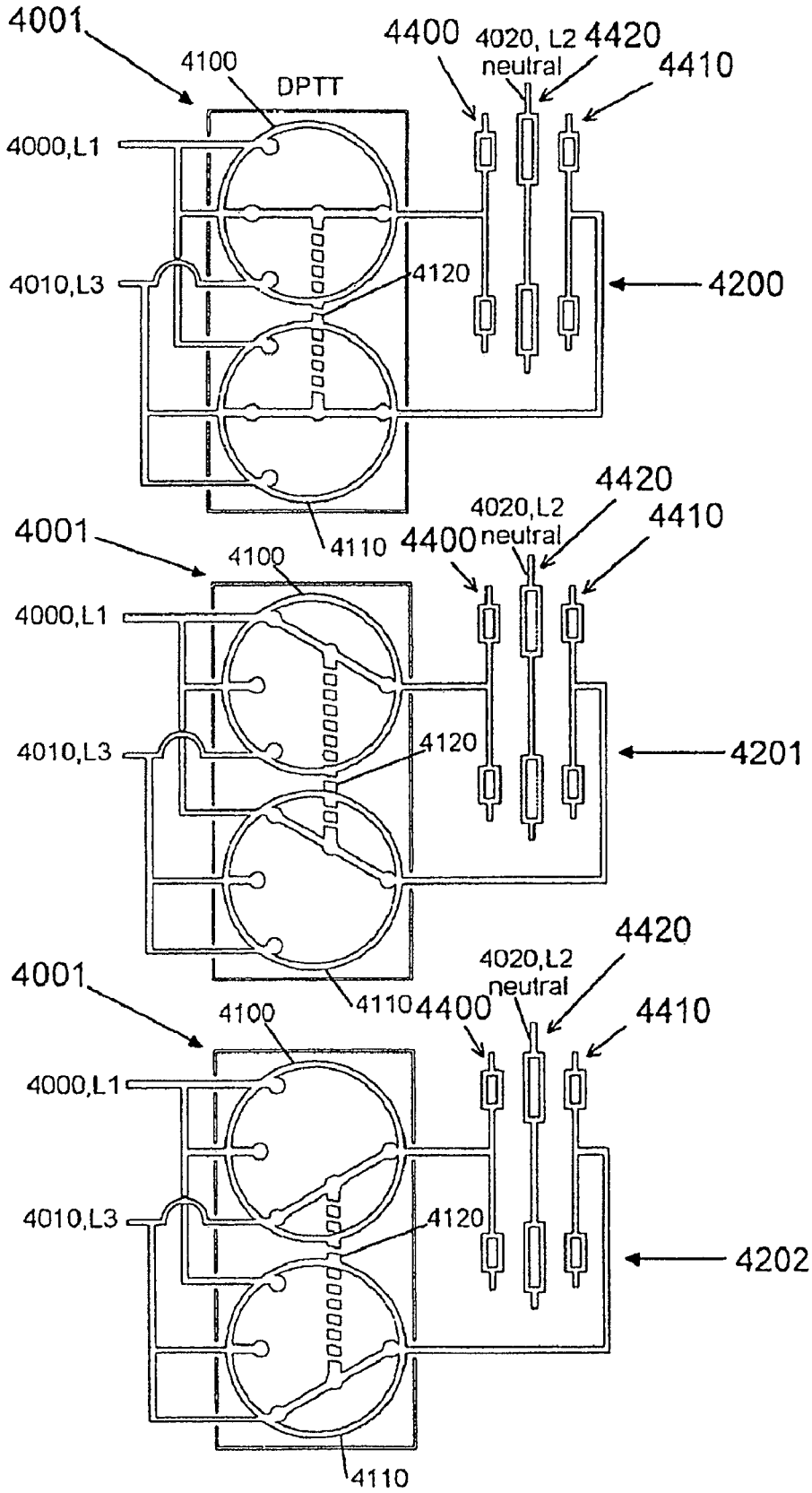
FIG. 2R is a schematic showing three different wiring positions of a switching mechanism for a TADS.

In some embodiments, the jumper itself has a switch in it that allows for one to switch between two different circuits without having to remove, rotate, and insert the jumper. A diagram of how such a switch system can work is shown in FIG. 2R. The switching system 4001 can include two three-position switches 4100 and 4110, with each switch being connected to one conducting element in the TADS (e.g., switch 4100 controlling conducting element 4400 and switch 4110 controlling conducting element 4410). FIG. 2R depicts three different settings 4200, 4201, and 4202 for the switching system 4001. Each setting shown displays the switch in a different position. In the first position, shown as setting 4200, conducting element 4400 is connected to a first line 4000, while the third element 4410 is connected to a third line 4010. A second line 4020, that can be separate from the switching mechanism, is connected to the second conducting element 4420. The second line can be a neutral line.

In the second position, shown as setting 4201, both of the switches 4100 and 4110 are moved upwards. While the first conducting element 4400 is still electrically connected to the first line 4000, the third conducting element 4410 is now disconnected from the third line 4010 and is now connected to the first line 4000. In this configuration, both the first and the third electrical conductors are connected to the first line 4000. As such, both sockets in this setting will have the electrical properties (e.g., switched or unswitched) of the first line 4000 and the second line 4020.

In the third position, shown as setting 4202, both of the switches 4100 and 4110 are moved downwards. The first electrical conductor 4400 is electrically connected to the third line 4010. Additionally, the third electrical conductor 4410 is electrically connected to the third line 4010. The first line 4000 will be disconnected from the TADS device. The second line 4020 will still be connected to the second conductor 4420. In this configuration both the first and the third electrical conductors are connected to the third line. As such, both sockets in this setting will have the properties of the third line 4010 and the second line 4020.

Thus, the above switching device can be used to switch the properties of a socket system (e.g., a TADS) so that one can select the electrical properties of the sockets. For example, when the first line 4000 has a switch in it (e.g., it is a switched circuit) and the third line 4010 does not have a switch (e.g., it is an unswitched circuit), then one can change the socket system between a) one that is half switched and half unswitched (as shown in setting 4200), b) one in which all of the sockets are switched (as shown in setting 4201), and c) one in which all of the sockets are unswitched (as shown in setting 4202).

In some embodiments, the above switch is part of the TADS itself and need not be placed in the jumper or in a removable jumper. In some embodiments, the entire switching system works within the jumper. In some embodiments, the switches can control whether or not an insulating member 3121 is present between the conducting member 3122 and the spring arm 3030. In such embodiments, both ends of the jumper can have a movable insulating member 3121. In other words, the switch can simply remove (or insert) the insulating member 3121 to form or break an electrical contact. In some embodiments, there is a connector 4120 between the two switches 4100 and 4110 so that a single manipulation can move both switches at once.

In a preferred embodiment, the switch is accessible and located on the outer surface of the TADS, and preferably is accessible when a cover plate is attached to the TADS. In some embodiments, the switching can be achieved by switching between two different jumpers. The jumpers will be structurally similar to asymmetric jumper 3100, although they will be in opposite orientations with respect to one another (e.g., FIG. 2L v. FIG. 2H). Thus, one can simply move a switch to engage one of the asymmetric jumpers or the other. By including a third position, in which no asymmetric jumper is connected to the first or third electrical conductors, one can also have a setting where the two different circuits are present in a single TADS at the same time.

Methods of using the above embodiments are also contemplated and are readily understood by one of skill in the art given the present disclosure. For example, in some embodiments, the method includes providing a TADS and inserting an asymmetric jumper 3100 into the TADS such that a first side of the asymmetric jumper connects an electrical conductor to a wire and such that a second side of the asymmetric jumper prevents the electrical connection of a third electrical conductor to a third wire, while providing an electrical contact between the first wire and the third electrical conductor. One can further remove the asymmetric jumper, rotate 180 degrees and reinsert it. Thus, a method for providing power from a first and second, or second and third electrical lines, from a single TADS, is provided.

Dual Circuits and Dual Sockets with a Tri-Aperture, Dual Socket Receptacle (TADS Receptacle)

In some aspects, the TADS is wired and used so as to allow one to select a particular circuit to draw power from while also allowing one to maintain the option of having two sockets for the first circuit, having two sockets for the second circuit, or having one socket for each circuit.

Frequently, multiple circuits have to be supplied to a single room in which heavy electricity demands require high amount of current. For example, in kitchens, where there may be heating elements, high power motors, cooling devices, etc, relatively high amounts of current can be required at any one point in time. In order to meet this requirement several independent circuits typically serve each area with high current needs. Thus, there can be three, four, five, or more circuits for a single room. Typically, each individual circuit (which provides an independent amount of current to the receptacles that are part of it) has multiple receptacles distributed throughout the room. However, due to the number of circuits, usually these receptacles are distributed in some manner. One issue that this results in is a "clutter" of electrical receptacles. Because people do not want five electrical receptacles at each point, the receptacles tend to be distributed throughout the entire room. While this reduces clutter, it requires going to separate sections of the room to access different circuits. Some of the present embodiments can overcome these as well as other issues by connecting two separate circuits to a TADS. An additional issue that traditional wiring arrangements result in is that one might typically run numerous groups of wires e.g., ROMEX wire, perhaps one per circuit, throughout an area. As noted below, in some embodiments, a single 14/3 or 12/3 ROMEX wire can serve two circuits when using a TADS receptacle. As will be appreciated by one of skill in the art, ROMEX wire is simply one example of the wiring that can be used. Any type of wiring system can be used with any of the disclosed embodiments, modified if required for each of the embodiments. For example, instead of using ROMEX wiring, each of the wires can be run through a metal conduit.

Figure 3A:
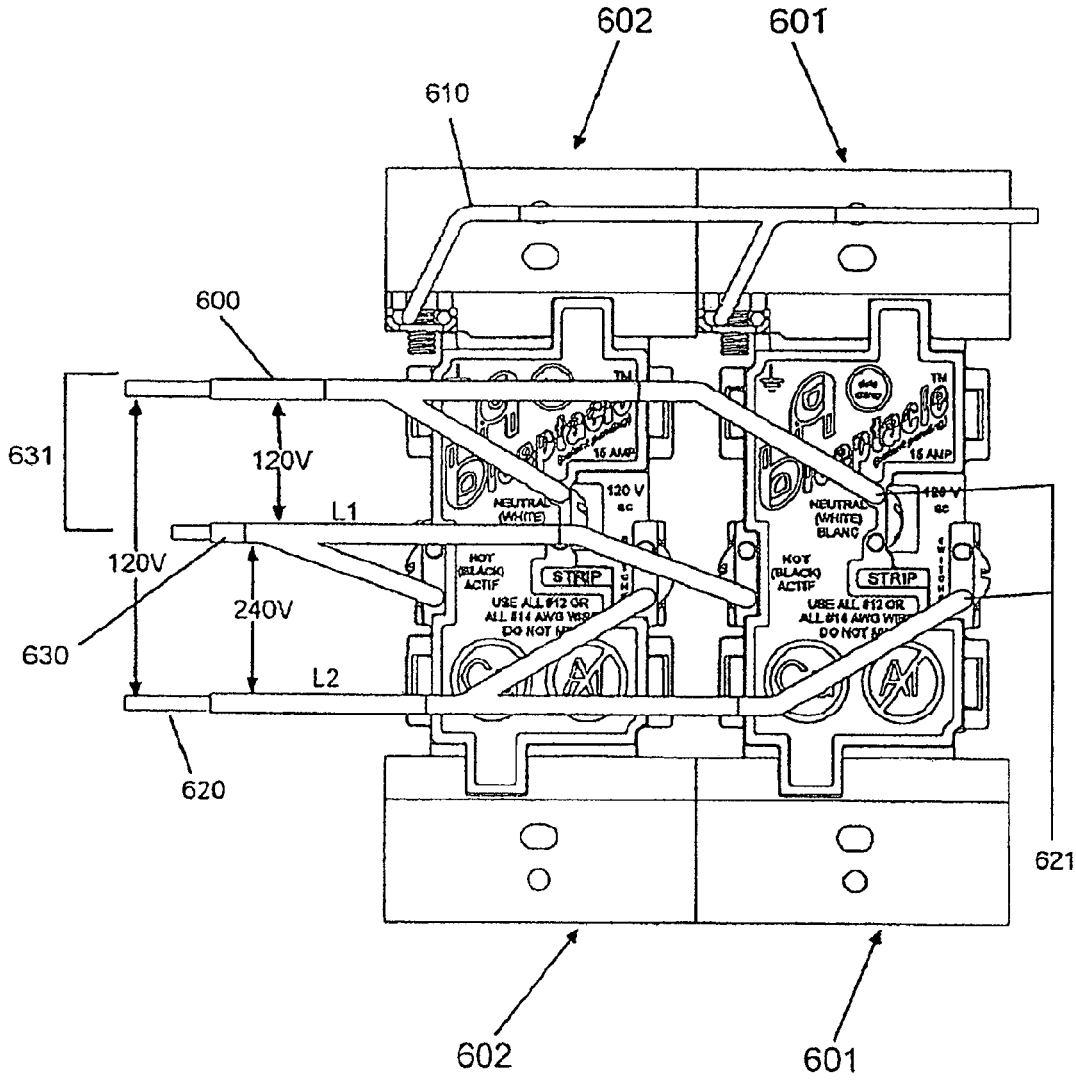
FIG. 3A depicts a wiring arrangement on the back surface of some embodiments of a TADS receptacle. This wiring arrangement, depending upon what wires 630 and 620 are connected to, can allow for access to two different circuits at a single TADS or for access to two-phase (240 V) power at a TADS.

A diagram for connecting a TADS so that two separate circuits can run through a single outlet, is shown in FIG. 3A. FIG. 3A depicts the backs of two TADS 601 and 602. A ground wire 610 is optionally connected to both TADS. A neutral wire 600 is also connected to the two TADS. Additionally, there is a first hot line 620, on a first circuit 621, and a second hot line 630, on a second circuit 631. As will be appreciated by one of skill in the art, each separate circuit can be controlled by a separate circuit breaker, fuse, or other device. The TADS receptacles in FIG. 3A are similar to that depicted in FIG. 2C, although there is no jumper 440, and so hot conductor 421 and hot conductor 421' are separate hot conductors, each connected to a separate circuit (621 or 631, FIG. 1C).

One advantage of this particular arrangement is that it allows two separate circuits 631 and 621 to be accessed at a single receptacle (e.g., 601). As will be appreciated by one of skill in the art, in use, there need not be two TADS receptacles side by side or even two TADS in a receptacle.

In some embodiments, another advantage that is achieved is that it allows multiple sockets, for each circuit, to be accessed at each receptacle. For example, in the embodiment shown in FIG. 1B, which has an upper TADS 2001 having a first and second socket 2010 and 2050 and a lower TADS 2002, with third and fourth sockets 2011 and 2051, one can access two sockets 2050 and 2051 on the second circuit 631 or two sockets 2010 and 2011 on the first circuit 621. Thus, one not only has access to two circuits at the receptacle, but one can also select the number of sockets that one wants to use on each circuit. For example, if one wishes to draw current from the first circuit 621, one can use sockets 2010 and/or 2011. If one wishes to draw current from the second circuit 631 one can use sockets 2050 and/or 2051. If one wishes to split a load between both of the circuits, one can use 2050 and 2011, or 2010 and 2051.

As will be appreciated by one of skill in the art, a single TADS is all that is required in order to provide access to two different circuits 621 and 631 via a first and a second socket 2010 and 2050. Thus, in some embodiments, the receptacle contains a single TADS, allowing a single neutral aperture (e.g., 2030) to serve two different circuits 621 and 631, via two sockets 2010 and 2050.

A more detailed description of some embodiments of the receptacle is now provided. The dual circuit device can be configured in a manner similar to a typical two TADS receptacle. For example, an electrical receptacle for allowing access to two voltage sources can have a first electrical conductor 421', a second electrical conductor 431, and a third electrical conductor 421. Unlike the embodiment in FIG. 2C, the first and third conductors do not share a jumper 440. Additionally, the receptacle itself can have a first socket 2010 and a second socket 2050. The first socket has a first aperture 2020 and a second aperture 2030. The second socket 2050 has the same second aperture 2030 and a third aperture 2025. The first aperture 2020 allows a first prong of an electrical plug (in the depicted embodiments a standard dual prong, type A electrical plug) to contact the first electrical conductor 421'. The second aperture 2030 allows a second prong of the electrical plug to contact the second electrical conductor 431, and the third aperture 2025 allows the first prong of the electrical plug to contact the third electrical conductor 421 when the second prong of the plug is in the second aperture 2030. In addition, the dual circuit TADS can have a first hot line 620 connected to the first conductor 421', a neutral line 600 connected to the second conductor 431, and a second hot line 630 connected to the third conductor 421. Additionally, the first and second hot lines 620 and 630 are each connected to a different circuit, namely a first circuit 621 and a second circuit 631.

In some embodiments, the first and second hot lines 620 and 630 and at least one neutral line 610 are part of a 12/3 or 14/3 NM wire. In some embodiments, the first hot line 620 is part of a first 20 amp circuit and the second hot line 630 is part of a second 20 amp circuit. In some embodiments, the first circuit 621 further comprises additional electrical receptacles and the second circuit 631 further comprises additional electrical receptacles. When such additional receptacles are in use, thereby drawing additional current in either the first or the second circuit, a user of the presently described TADS receptacle can then select if they want to draw additional power from either the first, the second, or both the first and the second circuits. Various methods of use of the device are outlined in more detail below.

In some embodiments, the first circuit 621 involves a first circuit breaker and the second circuit 631 involves a second circuit breaker. The first and second circuit breakers can keep the electricity delivered through the two circuits separate and independent of one another.

In some embodiments, the TADS is configured so that the first and second apertures allow for contact with the first 421' and second 431 conductors, where the first conductor is part of a first circuit that is on a first breaker. The second and third apertures allow for contact with the second 431 and third 421 conductors, where the third conductor 421 is connected to a second circuit on a second breaker. In some embodiments, a first current is flowing through the first circuit and a second, separate current is flowing through the second circuit. In a case in which a first appliance is plugged into socket 2010, current will be used between the first hot line (or voltage source) and the neutral voltage source. In a case in which a second appliance is plugged into socket 2051, current will be used from the second hot line (voltage source) and the neutral voltage source. These two circuits can flow simultaneously.

In some embodiments, the first hot line comprises a first voltage at a first phase, and the second hot line comprises a second voltage at a second phase. In a preferred embodiment, the voltages are alternating current (AC). In some embodiments, the first and second voltages are about 180 degrees out of phase. In some embodiments, the first and second hot lines are at least as heavy as a 12 gauge line. In some embodiments, the first and second hot lines are at least as heavy as a 10 gauge line. In some embodiments, the first and second hot lines are at least as heavy as an 8 gauge line.

Figure 3B:
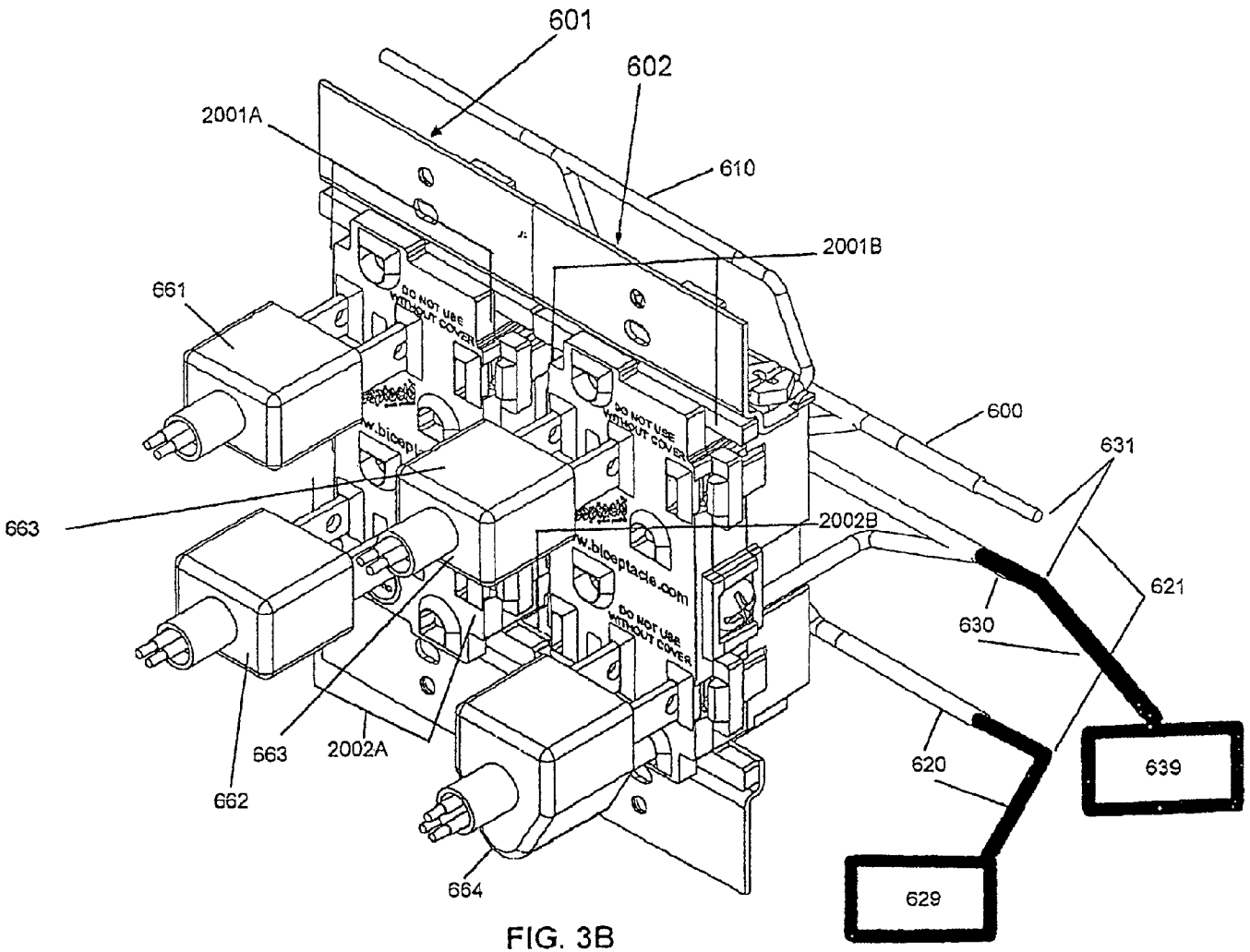
FIG. 3B depicts the front surface of the embodiment of the two TADS depicted in FIG. 3A.
Figure 3C:
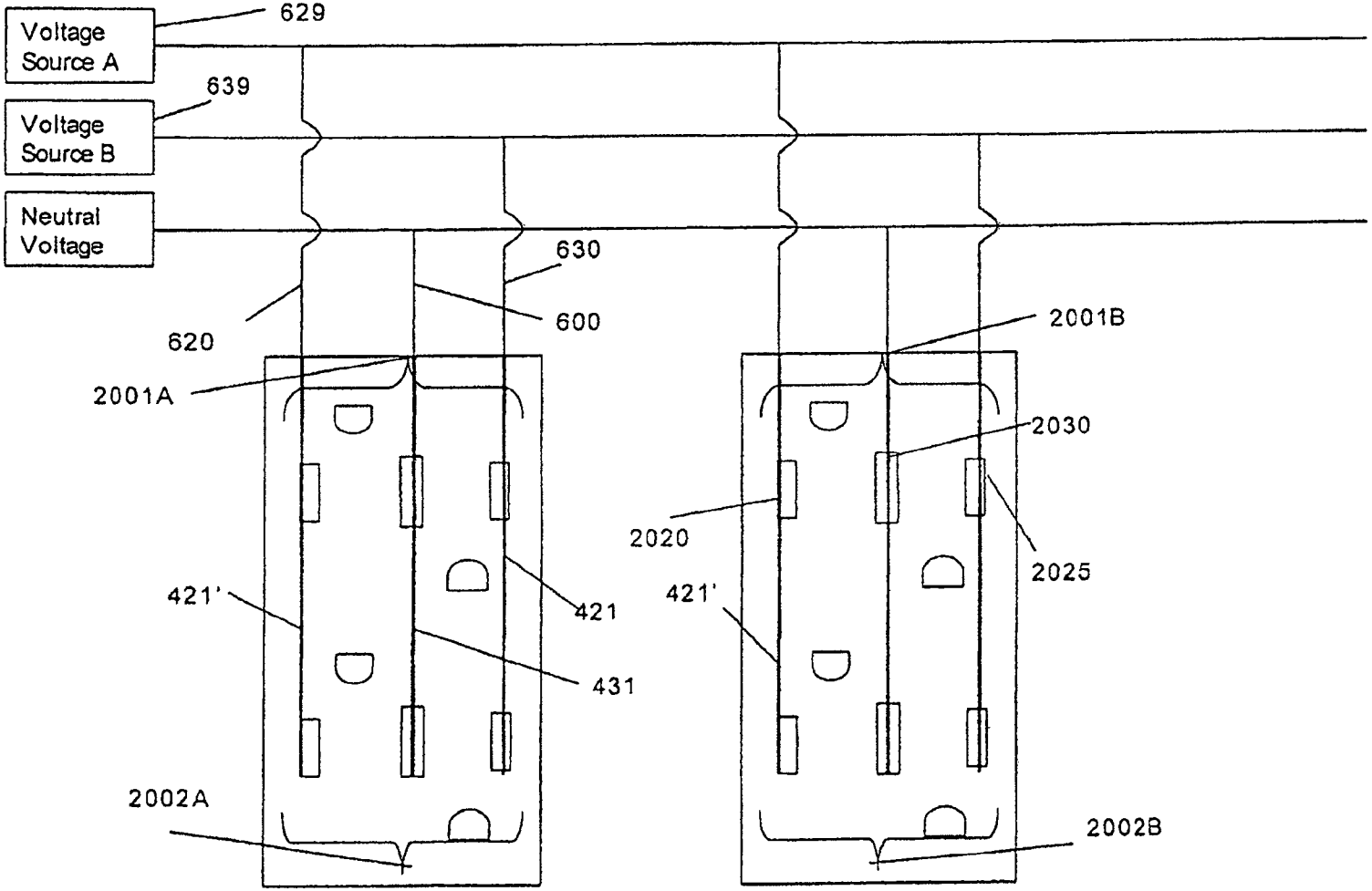
FIG. 3C depicts a wiring arrangement of two receptacles, each on two circuits, supplying a total of eight different sockets.

In some embodiments, a method for delivering power from two separate voltage sources to a single electrical receptacle is provided, for example, as shown in FIG. 3A, FIG. 3B, and FIG. 3C. The method involves providing a TADS receptacle. In the illustrated embodiment in FIG. 3B, there are two receptacles 601 and 602, each having two TADS 2001*a* and 2002*a* for the first receptacle 601, and 2001*b* and 2002*b* for the second receptacle 602. The TADS receptacles (their apertures and their conductors) are the same as noted previously (for example, similar to FIG. 2C, without the jumper 440).

In some embodiments, (see FIG. 3C) the first conductor 421' is conductively connected 620 to a first voltage source 629. The third conductor 421 is conductively associated 630 with a second voltage source 639. The second conductor 431 is conductively connected 600 to a neutral voltage source. One then inserts the plug into the receptacle and draws current from either the first or second voltage source, depending upon the orientation and placement of the plug. For example, in FIG. 3B (assuming that all of the plugs are polarized for this embodiment), one can insert a first plug 661 into a socket 2010 of the first TADS 2001A and draw on the first circuit 621 for power. Additionally, one can insert a second plug 662 into a socket 2011 of the second TADS 2002A and thereby draw more power from the same circuit 621. Thus, the TADS in such a receptacle can allow one to draw power from a single circuit from two sockets. Both of the plugs are preferably in a same orientation as well.

Additionally or alternatively, as shown in FIG. 3B in the second receptacle 602, one can insert a plug 663 into a socket 2010 in a first TADS 2001B to draw power from the first circuit 621. One can then insert another plug 664 into a socket 2051 on the second TADS 2002B to draw power from the second circuit 631. This can allow one to distribute the power used at a single electrical receptacle location over more than one circuit if one so desires. This can be achieved simply by changing the orientation of the plug to enter either the first or second socket of the TADS. In a preferred embodiment, the hot and neutral lines are part of ROMEX wire and can be 14/3 or 12/3 wire so that a single ROMEX wire can deliver two hot lines as needed, along with the required neutral line. As will be appreciated by one of skill in the art, the wires will be "hot" or "neutral" once they are arranged in a circuit and wired appropriately. For convenience, a neutral wire can generally be the wire associated with the neutral conductor. As will be appreciated by one of skill in the art, the plugs themselves need not be polarized or grounded or oversized, etc. The particular embodiments can have benefits regardless of the nature of the plug, simply by allowing a user to determine which circuit they want to draw power from. Additionally, the method can be practiced with a single TADS. While one can only insert one plug at a time into a single TADS, one can still obtain power from either circuit, depending on the selected socket.

As will be appreciated by one of skill in the art, the particular arrangement of plugs in FIG. 3B can be useful where the plugs in the first circuit 621 are associated with low load devices and the plug 664 in the second receptacle is part of a high load device (e.g., near the maximum load for the circuit, e.g., 20 amps).

The above embodiment can be useful in wiring situations where one may desire to monitor or adjust the load of any one of multiple circuits. For example, when using conventional receptacles in a situation where a first circuit (20 amp maximum) has two receptacles (A and B) and a second circuit (20 amp maximum) has two receptacles (C and D), if receptacle A is using almost all of the 20 amps, then receptacle B would be fairly useless, without tripping the breaker. Because of this, with a traditional wiring arrangement, one would have to go to another receptacle location (e.g., C or D) to plug in a second electrical device. As these receptacles could be placed relatively far apart from one another, this can be an inconvenience. Moreover, even in situations in which two circuits are fed into a single electrical receptacle (with the first circuit going to the top socket and the second circuit going to the bottom socket), one is then left with a situation in which one can only plug in a single electrical device into each circuit. This has the disadvantage of possibly eliminating half of the useable sockets in each outlet when one of the circuits is already maxed out from electrical devices connected to other receptacles in the same circuit. As noted above, in some embodiments, the present device allows a single receptacle to simultaneously supply access to two separate circuits, while still providing two more sockets for each circuit.

In some embodiments, a change in orientation of a plug is primarily all that is needed to obtain power from a TADS that is wired as shown in FIGS. 3A and 3B. Thus, this can be described as plug orientation dependent circuit selection.

As will be appreciated by one of skill in the art, one need not plug in multiple plugs, or have multiple plugs plugged in at that same time, to obtain some of the advantages disclosed herein.

As will be appreciated by one of skill in the art, in some of the above embodiments, one advantage that the TADS receptacle can have when wired to two separate circuits is that one need not dedicate the entire TADS to one circuit. Thus, while a traditional split receptacle could have one socket for each circuit, a user is limited by having only one socket at each receptacle. However, a TADS receptacle can allow the user to simultaneously use two sockets for the first circuit, two sockets for the second circuit, or one of both. Additionally, such an embodiment can also provide for the benefits described above in regard to the optional orientations of the plugs.

In other embodiments, a single traditional receptacle is wired for carrying a current for two separate circuits. In such an embodiment, the conductors for the hot conductor, are cut between the two sockets 1010 and 1011, allowing for a first hot wire from a first circuit to go directly to the upper socket and for a second hot wire from a second circuit to go directly to the lower socket.

More than One Phase Power from a Tri-Aperture, Dual Socket (TADS) Receptacle

In some embodiments, the TADS can be wired and power taken from them such that the AC voltage phases from two lines can be summed together. By doing this, "two-phase" (e.g., 240 V) power can be obtained from an otherwise "single-phase," (e.g., 120 V), TADS receptacle.

Figure 4:
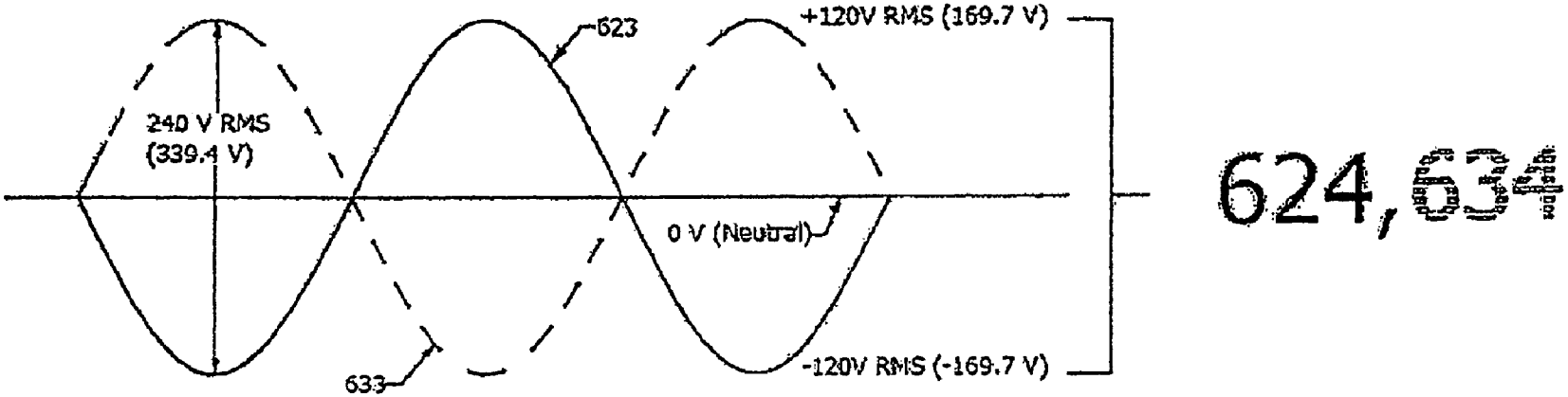
FIG. 4 depicts the voltage phases in two hot lines in some embodiments of the invention. As the voltages are 180 degrees out of phase, it allows one to access two-phase power from the TADS.

The wiring can be similar to that described above, for the two circuit systems (e.g., FIG. 3A, 3B, and FIG. 1C). Instead, the phases of the AC voltage in the first line 620 and the second line 630 can be about 180 degrees out of phase (as shown in FIG. 4). When the lines are about 180 degrees out of phase, then taking power from the first hot line 620, via the first conductor 421' and the first aperture 2020, and from the second hot line 630 via the third conductor 421 and the second aperture 2025, allows a 240 V socket to be created. As will be appreciated by one of skill in the art, this can allow normal sized boxes for receptacles to contain 240 V power. Additionally, areas that are already wired with two circuits to a single receptacle can be converted, through the use of the TADS and making the phases of the voltages 180 degrees different, into two-phase areas. Of course, simply installing the TADS in a new location will also provide the benefit of allowing 240 V or 120 V power in a standard sized or formatted receptacle.

As will be appreciated by one of skill in the art, the voltages need not be exactly 180 degrees out of phase for all embodiments, as one need not obtain exactly 240V to effectively operate a device that works on "240 V."

In some embodiments, the TADS receptacle configured for delivering two-phase power has first 421', second 431, and third 421 electrical conductors as well as the element having the aperture arrangement of a TADS receptacle. The TADS receptacle is further connected to a first hot line 620 connected to the first conductor 421', a first neutral line 600 connected to the second conductor 431, and a second hot line 630 connected to the third electrical conductor 421, wherein the first and second hot lines 620 and 630 are each at least as heavy as 12 gauge wire. In some embodiments, the first and second hot lines are at least as heavy as 10 gauge wire.

Referring to FIG. 4, in some embodiments, the first conductor 421' and the first hot line 620 have a first voltage 624 having a first phase 623 and the third conductor 421 and the second hot line 630 have a second voltage 634 having a second phase 633. In some embodiments, the first and second voltages are out of phase by about 180 degrees as shown. As noted herein, the voltages need not be exactly 180 degrees out of phase for the device to operate, as many devices can operate within a range of voltages.

As will be appreciated by one of skill in the art, having 240 V power available can allow one to use amounts of current and thus wires, that one might not otherwise use. For example, as the actual current drawn through the wire for the same amount of work can be less at 240 V than at 120 V, the gauge of the wire can be thinner than otherwise allowed. Thus, a wire thinner than a standard wire, e.g., thinner 14, 16, or 18 gauge, can be used, in some embodiments. In other embodiments, the 240 V receptacle and plug allows heavier devices to be used that might draw more current. For example, one could provide enough current to operate a household dryer. Thus, gauges heavier than 12 can be used, e.g., 10, 8, or thicker. Thus, while a normal electrical receptacle might only be wired with a 14 or 12 gauge wire, the two-phase receptacles can be wired with a wire heavier than 12 or lighter than 14.

In some embodiments, a method for providing two-phase power at an electrical receptacle is provided. This can involve providing a TADS receptacle with three separate electrical conductors (421, 431, and 421') in the receptacle. The receptacle has an element with a first socket 2010 and a second socket 2050. The first socket has a first aperture 2020 and a second aperture 2030. The second socket 2050 has the second aperture 2030 and a third aperture 2025. In this method, a first voltage source 629 producing a voltage 624 with first phase 623 is supplied to the first conductor 421', e.g., via a first line 620. Additionally, the third electrical conductor 421 is connected to a second voltage source 639 producing a voltage 634 having a second phase 633. The first and second phases 623 and 633 are preferably 180 degrees out of phase. As shown in FIG. 4, this results in a net of 240V AC between the two conductors. In some embodiments, all that is required is for one to install a TADS and then to simultaneously draw power from the first and third conductors 421' and 421. In some embodiments, the method involves inserting a first prong 710 (FIG. 5A) of an electrical plug 700 into the first aperture 2020 and inserting a second prong 730 of the electrical plug 700 into the third aperture 2025. In some embodiments, the plug is part of an electrical device and one then turns on the device. In some embodiments, the device is one that operates on 240 volts.

In some embodiments, the method includes drawing single phase power from the same electrical receptacle, and optionally, from the same plug. In some embodiments, the method further involves providing an electrical plug that further has a neutral prong 720 located between the first and second prongs 710 and 730. One then inserts the neutral prong 720 into the second aperture 2030, which can contact the second electrical conductor 431, thereby supplying single phase power between the first 421' and second 431 and/or second 431 and third 421 conductors. As will be appreciated by one of skill in the art, in receptacles in which there are two TADS, the second TADS can be used to obtain the 120 V power, via, e.g., a traditional Type A electrical plug, or the second TADS can be used as a second socket for another 240 V device. Of course, there need not be two TADS in a receptacle.

In some embodiments, a method for providing 240 volt AC current is provided. The method involves providing a first hot (in this case 120 V AC) line 620 to an aperture 2020 in an electrical receptacle. The method further involves providing a second hot (also 120 V AC) line 630 to an aperture 2025 in the electrical receptacle. Additionally, the apertures 2020 and 2025 are located approximately twice as far apart as the distance between two apertures for a type A electrical plug (e.g., the apertures for a type A plug can be distanced about 1 to 1.5 cm, resulting in a doubling of distance of about 2.0-3.0, 2.1-2.9, 2.3-2.7, or 2.35-2.7 cm). One can then apply a first voltage 624 with a first phase 623 to the first hot line 620 and a second voltage 634 with a second phase 633 to the second hot line 630. The voltage phases are preferably about 180 degrees out of phase. In some embodiments, one then draws current from the first and second hot lines simultaneously. In some embodiments, the first and second voltages 623 and 633 are each about 120 volts. In some embodiments, one also provides a neutral line 600 to a third aperture 2030 in the receptacle; and then contacts the neutral line 600 with a prong 720 of the plug 700, thereby allowing 120 volt power to be obtained.

Additionally, one of skill in the art, given the present disclosure will also be able to use the TADS to obtain voltages other than 240 V. In some embodiments, the device can be used to increase voltages in any situation where an increase in voltage results from a difference in voltages.

Double/Single TADS Electrical Plug

As will be appreciated by one of skill in the art, a variety of plug configurations are possible for obtaining 240V from the above embodiment. The plug preferably allows the prongs of the plug to electrically contact the first and second hot conductors (e.g., the first conductor 421' and third conductor 421 via the aperture 2020 and the aperture 2025). In embodiments involving standard type A plugs, then the distance between the two prongs will be approximately twice that of the distance between two prongs on a normal plug. However, a variety of configurations are possible, as long as the plugs are configured to engage at least two hot conductors.

Some embodiments of the two-phase electrical plug have only the first and second prongs located relatively far apart from one another (approximately twice the normal distance). The prongs are partially contained within a housing structure, which allows at least a part of the first and second prongs to be exposed so they can enter the first and third apertures (FIG. 1B, 2020 and 2025). For Type A related embodiments, the exposed part of the first and second prongs are generally shaped as a rectangular when viewed on end. (FIG. 5A, lower right panel).

As will be appreciated by one of skill in the art, the plug can also have a ground prong. In some embodiments, the ground prong 750 is not located on an axis of symmetry between the first 710 and second 730 prongs. In some embodiments, the ground prong is located on an axis about one-quarter of the distance between the first prong 710 and second prong 730.

As will be appreciated by one of skill in the art, in light of the present disclosure, one can modify the plug for other, non-type A plugs and TADS as well. Generally, the distance between the prongs will be about twice the distance between the prongs of a conventional plug, when measured from the first aperture, to the second aperture, to the third aperture.

Figure 5A:
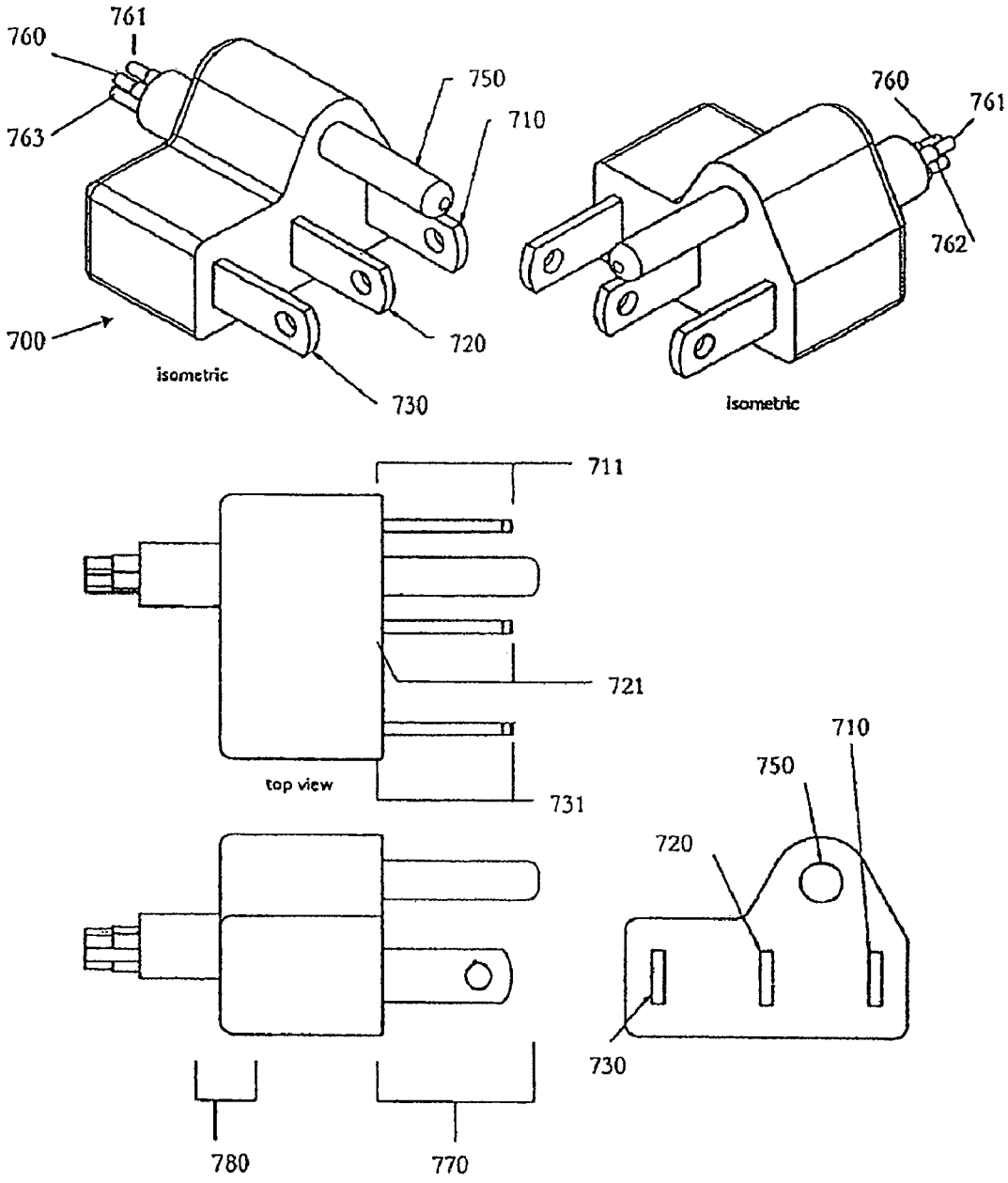
FIG. 5A depicts various views of an electrical plug for accessing two-phase (e.g., 240 V) power from a TADS.

In the embodiment of the plug 700 depicted in FIG. 5A, the two-phase electrical plug for use with a TADS receptacle has a first prong 710, a second prong 720, and a third prong 730. The prongs are positioned by a structure (e.g., a housing) that keeps the distance between the first and second prongs and the distance between the second and third prongs approximately equal to the distance between the two prongs of a standard size conventional electrical plug. For the U.S. a two prong (e.g., Type A) electrical plug can typically have a distance of about 1.5 cm to 1.0 cm, 1.4 cm to 1.0 cm, or 1.4 to 1.1 cm between the two circuit prongs of the plugs. In FIG. 5A, the prongs 710, 720, and 730, are kept separate by a housing 700 which contains at least a part of the first, second, and third prongs 710, 720, and 730 and leaves exposed an end of the first, second, and third prongs 711, 721, and 731, which can be inserted into the apertures of a TADS. In this embodiment, the first, second and third prongs 710, 720, and 730 are arranged in a single line. As can be seen in the figure, the plug can further have one or more grounding prongs 750. In some embodiments, the first and third prongs 710 and 730 are about twice as far apart as a type A electrical plug. In some embodiments, the first grounding prong 750 is not located on an axis of symmetry between the first 710 and third prongs 730, but is located on an axis of symmetry between the second 720 and third 730 or the first 710 and second prongs 720.

One embodiment for how the conductors (i.e., inside the electrical cord) connected to the prongs can be arranged is shown in FIG. 5A. In this embodiment, four conductors (lines) leave the plug housing. There is a first line 760 connected to the first prong 710, a second line 761 connected to the second prong 720 and a third line 762 connected to the third prong 730. In some embodiments, the first line is at least as heavy as 12 or 10 gauge. In some embodiments, the third line is at least as heavy as 12 or 10 gauge. In some embodiments, the plug further comprises a fourth line 763 connected to the ground prong 750. In some embodiments, such as those in which less current needs to be drawn though the device because the device operates at 240 V, the wires can be lighter than standard wires, e.g., lighter than 14 or even 16 gauge wires.

Figure 5B:
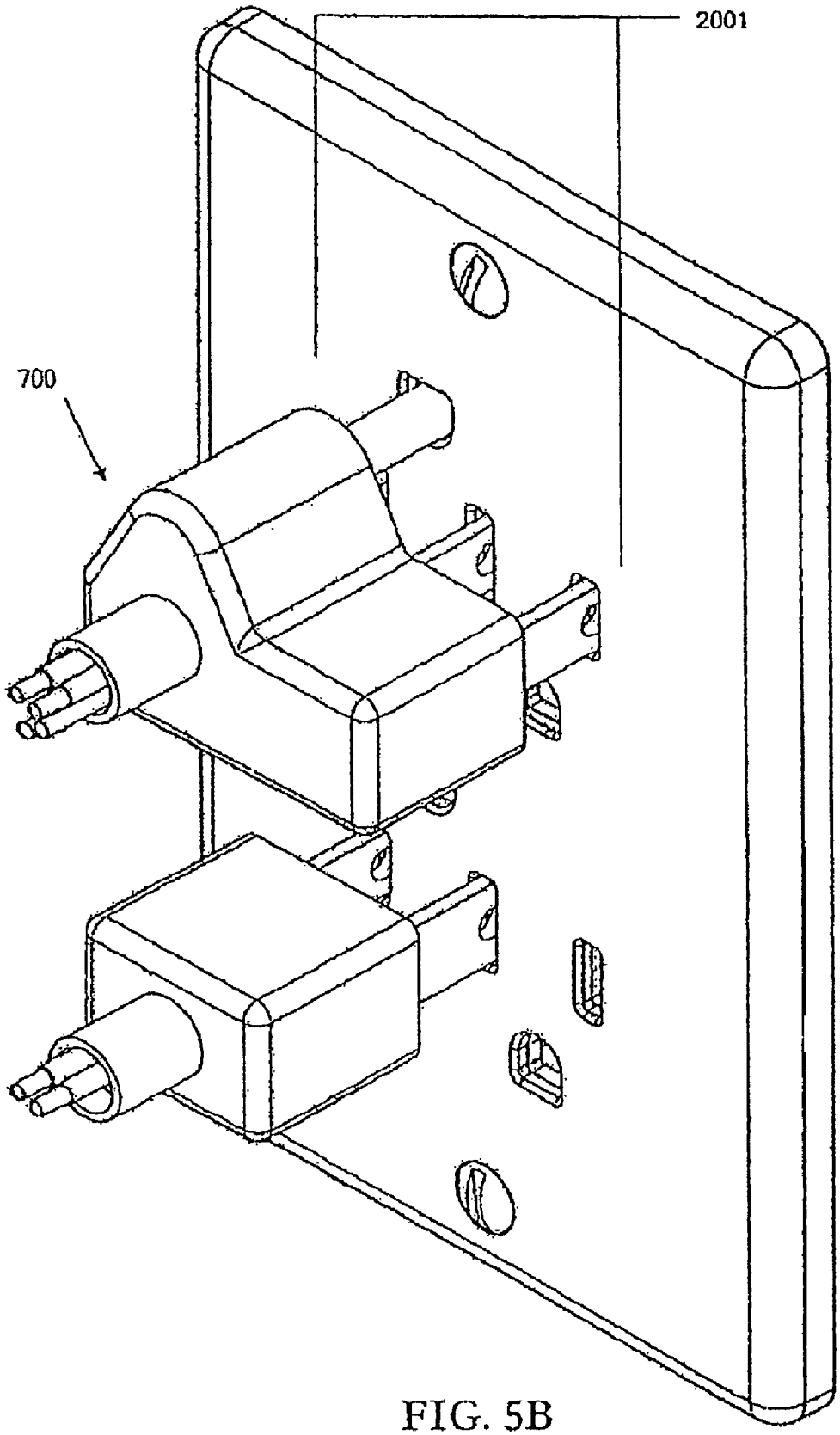
FIG. 5B depicts an embodiment of how one can access two-phase power (e.g., 240 V and/or 120 V power) from a TADS.

In some embodiments, the plug is inserted into a TADS, such as in FIG. 5B. In some such embodiments, the first 760 and third 762 lines are connected to a load that uses 240 V power. In some embodiments, the device may also employ single phase power. Thus, the first 760 and second 761 or said second 761 and third 762 lines are connected to a load that uses single phase power. Both single and 240 V power can be drawn upon through a TADS with such a plug. This can even occur simultaneously.

Additionally, in some embodiments, the plug 700 is inserted into a TADS, thereby providing both single and two-phase (120 and 240 V) power via the plug. Such an embodiment is shown in FIG. 5B. This particular embodiment allows both 240 V or 120 V power. Additionally, this particular embodiment includes a ground prong 750. The position of the ground prong is not critical and can be repositioned, if desired. Additionally, the "neutral" prong is optional, and only required if 120 V may also be desired by the device to which the plug belongs. In such an embodiment, the first prong 710 and the second prong 720 (or the second and third 730) can be used to obtain the 120V power. In some embodiments, an additional grounding plug can be added so that the grounding of the 240 V device can be isolated from the grounding of the 120 V device.

Figure 5C:
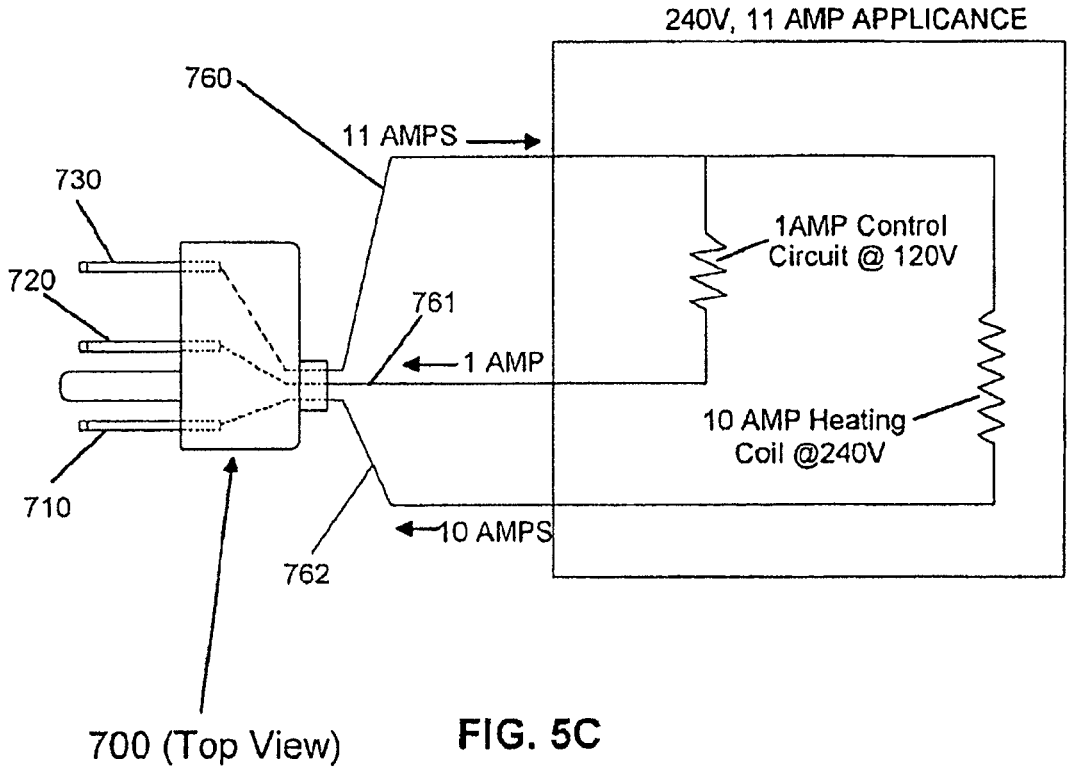
FIG. 5C depicts one embodiments of the current flow for a device having the 240 V plug and drawing both 240 V and 120 V power.

One embodiment of the plug is depicted in FIG. 5C, which also depicts current flow through the plug. In such an embodiments, the first 760 and third 762 lines are connected to a load that uses 240 V power and draws 10 amps. The device can also employ single phase power. Thus, the first 760 and second 761 lines are connected to a load that uses single phase power and draws a single amp at 120 V.

Plug Converter

As will be appreciated by one of skill in the art, many two-phase or single phase devices do not currently have the electrical plug shown in FIG. 5A. Because of this, it can be advantageous to use a plug converter or adapter to transform the above plug formats into a more traditional plug format. Such an adapter can have a prong facing section of the housing 770 as shown in FIG. 5A. Additionally, the adapter can have a rearward portion of the housing 780 that (unlike FIG. 5A) will not have a power line, but rather a receptacle surface so that single or double phase electrical plugs can be inserted into it. Some examples of two phase NEMA plugs (and thus the receptacle surface that could be used) include 2-15, 2-20, 2-30, L2-15, L2-20, L2-30, 6-15, 6-20, 6-30, 6-50, L6-15, L6-20, L6-30, L6-50, 11-15, 11-20, 11-30, 11-50, L11-15, L11-20, L11-30, L11-50, 15-15, 15-20, 15-30, 15-50, 15-60, L15-15, L15-20, L15-30, L15-50, L15-60. As will be appreciated by one of skill in the art, the receptacle on the rearward section of the plug 780, can be configured for any type of plug. In some embodiments, the prong section of the adapter will just have the two outer most prongs, which can be spaced approximately twice as far apart as the distance between the current prongs in a type A plug.

Additionally, as will be appreciated by one of skill in the art, there are a variety of the types of plugs that can be used with a TADS. All that needs to occur to the TADS, preferably, is an adjustment of the positioning and shaping of the apertures. Examples of plug types include, NEMA 10-20, 10-30, 10-50, 14-30, 14-50, 6-15, 6-20, 6-30, 6-50, NEMA 2, Pin and sleeve circular connectors, IEC 60309, and BS EN 60309-2. The plug adaptors and various embodiments of the TADS can also be configured for Type A plugs, NEMA 2-15, 2-20, JIS 8303, Class II, type B plug, NEMA 5-15, NEMA 5-20, 5-30, 5-50, NEMA 1-15, 5-15, Lewden plugs, Type C plugs, CEE 7/16, CEE 7-17, BS 4573, sockets, Type D, BS 546, Type E, French type E, Type F, CEE 7/4, Gost 7396, Type E & F hybrid, Type G, BS 1363, Type H, Type I, AS 3112, CPCS-CCC, IRAM 2073, Type J, SEV 1011, IEC 60906-1, Type K, Type L, CES 23-16/VII 10 A, CEI 23-16/VII 16 A, and Type M, for example.

Given the above disclosure, one of skill in the art can readily adjust the above TADS so that any of the other receptacles for any of the other plugs are also tri-aperture, dual socket systems, or the receptacle can be added to the back 780 of an adapter. For some of these modified TADS, all that is required is that the first socket share only one aperture with the second socket. In some embodiments, the first socket can share at least one aperture with the second socket, but neither socket contains all of the apertures of the other socket. In some embodiments, the first and second sockets share one aperture, and the plug to be inserted is inserted into the first socket in a first orientation and inserted into the second socket in a second orientation.

What is claimed is:

1. A method of providing power to an oversized electrical plug, said method comprising:

providing an electrical receptacle, comprising:

a first electrical conductor;

a second electrical conductor; and a receptacle having a first aperture, a second aperture, and a third aperture, wherein the first aperture allows a first prong of a type A electrical plug in a first orientation to contact the first electrical conductor, wherein the second aperture allows a second prong of the electrical plug in the first orientation to contact the second electrical conductor, and wherein the third aperture allows the first prong of the electrical plug in a second orientation to contact the first electrical conductor when the second prong of the electrical plug in the second orientation is inserted into the second aperture; and inserting the prongs of an oversized electrical plug into two apertures, wherein said two apertures form a first socket, and wherein said oversized plug is large enough to at least, in some orientation, partially cover the first socket it is inserted into while simultaneously at least partially covering another socket on the electrical receptacle that is not made up of the first, second, or third apertures.

2. The method of claim 1, wherein said second aperture is configured to accept a polarized prong of the oversized electrical plug, and wherein the first and third apertures are positioned on either side of the second aperture.

3. The method of claim 2, wherein a first and second prong of the oversized plug are inserted into the first and second apertures of the electrical receptacle respectively.

4. The method of claim 1, further comprising:

providing the electrical receptacle that further comprises a fourth aperture, a fifth aperture, and a sixth aperture, wherein the fourth aperture allows a first prong from a second plug to contact the first electrical conductor, wherein the fifth aperture allows a second prong from the second plug to contact the second electrical conductor, and wherein the sixth aperture allows the first prong from the second plug to contact the first conductor when said second prong from the second plug is inserted into the fifth aperture.

5. The method of claim 4, further comprising inserting a set of prongs of a second oversized electrical plug into the fifth and sixth apertures, wherein the fourth aperture is in line with the first aperture, the fifth aperture is in line with the second aperture, and the sixth aperture is in line with the third aperture.

6. The method of claim 5, wherein the first and second oversized plugs are rotated 180 degrees with respect to one another.

7. The method of claim 4, wherein said electrical receptacle further comprises a first ground aperture, a second ground aperture, a third ground aperture, and a fourth ground aperture, wherein a grounding prong of the first plug is inserted into the first ground aperture and wherein a grounding prong of the second plug is inserted into a fourth ground aperture.

8. An electrical receptacle for allowing access to two voltage sources, said electrical receptacle comprising:

a first electrical conductor;

a second electrical conductor;

a third electrical conductor;

an element having a first and second sockets, the first socket comprising: a first aperture and a second aperture, the second socket comprising: the second aperture and a third aperture, wherein the first aperture allows a first circuit prong of an electrical plug to contact the first electrical conductor, wherein the second aperture allows a second circuit prong of the electrical plug to contact the second electrical conductor, wherein the third aperture allows the first circuit prong of the electrical plug to contact the third electrical conductor when the second circuit prong of the plug is in the second aperture;

a first hot line connected to the first conductor;

a first neutral line connected to the second conductor; and a second hot line connected to the third conductor, wherein the first and second hot lines are each part of a different circuit.

9. The electrical receptacle of claim 8, wherein the first hot line is within a circuit controlled by a first circuit breaker.

10. The electrical receptacle of claim 8, wherein the second hot line is within a circuit controlled by a second circuit breaker.

11. The electrical receptacle of claim 8, wherein the first and second hot lines and the first neutral lines are part of a 12/3 or 14/3 NM wire.

12. The electrical receptacle of claims 8, wherein the first hot line is part of a first 20 amp circuit and wherein the second hot line is part of a second 20 amp circuit.

13. The electrical receptacle of claim 8, wherein the first hot line comprises a first voltage at a first phase, and wherein the second hot line comprises a second voltage at a second phase, wherein the first and second voltages are about 180 degrees out of phase.

14. The electrical receptacle of claim 13, wherein the first and second hot lines are at least the size of a 14 gauge line.

15. The electrical receptacle of claim 14, wherein the first and second hot lines have a size that are at least of the size selected from the group consisting of 12 and 10 gauge line.

16. The electrical receptacle of claim 15, wherein the first and second hot lines are at least the size of a 8 gauge line.

17. A method for delivering two independent circuits to a single electrical receptacle, said method comprising:

providing an electrical receptacle comprising:

a first electrical conductor;

a second electrical conductor;

a third electrical conductor; and a element having first and second sockets each adapted to receive two circuit plugs of a standard-size electrical plug, the first socket comprising first and second apertures in the element, the second socket comprising the second aperture and a third aperture in the element, wherein insertion of a prong of an electrical plug into the first aperture provides electrical communication between the prong and the first electrical conductor, wherein insertion of a prong of an electrical plug into the second aperture provides electrical communication between the prong and the second electrical conductor, wherein insertion of a prong of an electrical plug into the third aperture provides electrical communication between the prong and the third electrical conductor when said second prong of the electrical plug is inserted into the second aperture, wherein said first conductor is conductively associated to a first circuit, and wherein said third conductor is conductively associated with a second circuit, whereby inserting an electrical plug into the first socket allows one to use the first circuit and whereby inserting the electrical plug into the second socket allows one to use the second circuit.

18. The method of claim 17, further comprising inserting a first electrical plug into the first or second sockets.

19. The method of claim 17, wherein the first circuit includes a first hot wire and a first breaker and wherein the second circuit includes a second hot wire and a second breaker.

20. The method of claim 17, wherein the element further includes third and fourth sockets each adapted to receive two circuit prongs of an electrical plug, the third socket comprising fourth and fifth aperture in the element, the fourth socket comprising the fifth aperture and a sixth aperture in the element, wherein insertion of a prong of an electrical plug into the fourth aperture provides electrical communication between the prong and the first electrical conductor, wherein insertion of a prong of an electrical plug into the fifth aperture provides electrical communication between the prong and the second electrical conductor, wherein insertion of a prong of an electrical plug into the sixth aperture provides electrical communication between the prong and the third electrical conductor, the method further comprising:

inserting a second plug into the third or fourth sockets, so that the first and second plugs are not both in electrical communication with the first conductor or the third conductor at the same time.

21. The method of claim 20, wherein a voltage in the first circuit and a voltage in the second circuit are 180 degrees out of phase.

22. The method of claim 20, wherein when the plug is inserted into the first or third sockets, the plug is in a first orientation and when the plug is inserted into the second or fourth sockets the plug is in a second orientation.

23. The method of claim 22, wherein the first and second orientations are 180 degrees different.

24. The method of claim 17, wherein the element further includes third and fourth sockets each adapted to receive two circuit prongs of an electrical plug, the third socket comprising fourth and fifth aperture in the element, the fourth socket comprising the fifth aperture and a sixth aperture in the element, wherein insertion of a prong of an electrical plug into the fourth aperture provides electrical communication between the prong and the first electrical conductor, wherein insertion of a prong of an electrical plug into the fifth aperture provides electrical communication between the prong and the second electrical conductor, wherein insertion of a prong of an electrical plug into the sixth aperture provides electrical communication between the prong and the third electrical conductor, the method further comprising:

inserting a second plug into the third socket, so that the first and second plugs are both in electrical communication with the first conductor at the same time.

25. The method of claim 17, wherein the element further includes third and fourth sockets each adapted to receive two circuit prongs of an electrical plug, the third socket comprising fourth and fifth aperture in the element, the fourth socket comprising the fifth aperture and a sixth aperture in the element, wherein insertion of a prong of an electrical plug into the fourth aperture provides electrical communication between the prong and the first electrical conductor, wherein insertion of a prong of an electrical plug into the fifth aperture provides electrical communication between the prong and the second electrical conductor, wherein insertion of a prong of an electrical plug into the sixth aperture provides electrical communication between the prong and the third electrical conductor, the method further comprising:

inserting a second plug into the fourth socket, so that the first and second plugs are both in electrical communication with the third conductor at the same time.

* * * * *